US009242702B1

(12) United States Patent
Rich

(10) Patent No.: US 9,242,702 B1
(45) Date of Patent: Jan. 26, 2016

(54) ANCHOR BUOY

(71) Applicant: Kyle Rich, Lake Forest, CA (US)

(72) Inventor: Kyle Rich, Lake Forest, CA (US)

( * ) Notice: Subject to any disclaimer, the term of this patent is extended or adjusted under 35 U.S.C. 154(b) by 0 days.

(21) Appl. No.: 14/497,155

(22) Filed: Sep. 25, 2014

(51) Int. Cl.
*B63B 22/02* (2006.01)
*B63B 21/22* (2006.01)

(52) U.S. Cl.
CPC ..... *B63B 22/02* (2013.01); *B63B 2021/225* (2013.01)

(58) Field of Classification Search
CPC ..... B63B 22/02; A01K 93/00
See application file for complete search history.

(56) References Cited

U.S. PATENT DOCUMENTS

| | | | | |
|---|---|---|---|---|
| 2,414,658 | A * | 1/1947 | Mochel | 254/389 |
| 2,666,934 | A * | 1/1954 | Leifheit | 441/3 |
| 2,849,827 | A * | 9/1958 | Gardiner | 43/44.9 |
| 4,028,759 | A * | 6/1977 | Toups | 441/29 |
| 4,280,237 | A | 7/1981 | Petrie | |

FOREIGN PATENT DOCUMENTS

CN 202911920 U 5/2013

OTHER PUBLICATIONS

Anchor Pendant Buoys from Evergreen Maritime, accessible at http://www.evergreenmaritime.com/products-and-solution/surface-buoyancy/anchor-pendant-buoys/; last accessed on Apr. 25, 2014.
Spherical Mooring Buoys from Blue Ocean Tackle, accessible at http://www.blueoceantackle.com/spherical_steel_buoys.htm; last accessed on Apr. 25, 2014.
Mooring Buoys, accessible at http://www.jimbuoy.com/pages/marine/mooring.htm; last accessed on Apr. 25, 2014.

* cited by examiner

*Primary Examiner* — Edwin Swinehart
(74) *Attorney, Agent, or Firm* — Knobbe Martens Olson and Bear LLP

(57) ABSTRACT

A floating buoy for use in securing a looped wire assembly in marine environments is disclosed. The anchor buoy may include a buoyant body and a first opening and a second opening formed in the buoyant body, the first and second openings forming a passage through the buoyant body. The floating buoy may also include a loop-securing structure detachably connected to the buoyant body adjacent to the first opening, the loop-securing structure movable from a first position to a second position and vice versa, the loop-securing structure configured to cover the first opening such that the loop-securing structure in the first position defines a third opening that is narrower than both of the first opening and the second opening.

24 Claims, 22 Drawing Sheets

ANCHOR BUOY

BACKGROUND OF THE INVENTION

1. Field of the Invention

The invention relates to equipment for use in marine operations and more particularly to the use of a floating anchor buoy in such operations.

2. Description of the Related Art

Many marine operations make use of floating buoys to indicate subsurface locations of interest or to secure lines of various types at the surface of the water to provide a convenient way of locating and securing these lines. Some buoys may be used as mooring buoys. Mooring buoys are generally semi-permanent or permanent features that float on the surface of the water to mark the location of an anchor. Mooring buoys typically include an anchor chain attached to the anchor. Due to their permanence or semi-permanence, mooring buoys are not generally used to quickly move an anchor.

One particular application for floating buoys, for example, includes securing lines at the surface for the raising and lowering of anchors for marine vessels. Floating anchor buoys are frequently used to mark the surface locations above the anchor and secure a looped line or picking eye for quickly and easily moving the anchor. A cable or wire rope generally extends from the top or securing side of the anchor through the buoy, with a loop or picking eye extending above the surface of the water such that the loop can be easily captured by a vessel to raise and move the anchor to another position.

In general, mooring and floating anchor buoys are formed from heavy steel cylinders or spheres. Modifying these steel structures to receive a looped anchor cable can be difficult, time consuming, and pose some risk of injury to the worker. Splicing or otherwise forming the loop of the wire cable after the cable has passed through the buoy increases the amount of time needed to prepare the buoy for use and can pose a safety risk to persons near the buoy. A floating anchor that can quickly and easily accommodate and secure a looped cable line above the surface of the water would solve many of the disadvantages of prior designs.

SUMMARY OF THE INVENTION

Embodiments of the invention provide floating buoy cans that are easy and safe to manufacture and that will easily secure a looped line above the water.

In one aspect, a floating buoy for holding an anchor line having a loop at one end is disclosed. The buoy includes a buoyant body, a first opening and a second opening formed in the buoyant body, the first and second openings connected by a passage through the buoyant body, the first and second openings and the passage sized to allow a loop in an anchor line to move through the first opening and through the passage and through the second opening, and a first loop-securing structure connected to the buoyant body to provide a third opening sized to allow the anchor line to move therethrough and to prevent the loop from moving therethrough. In some embodiments, the first loop-securing structure is detachably connected to the buoyant body. In some embodiments, the first loop-securing structure is configured to have first and second positions such that, when the first loop-securing structure is in the second position, the third opening is sized to allow the anchor line to move therethrough and to prevent the loop from moving therethrough, and such that, when the first loop-securing structure is in the first position, the third opening is larger than it is when the first loop-securing structure is in the second position.

In some embodiments, the first loop-securing structure comprises a first plate and a second plate, each of the first and second plates detachably connected to the buoyant body adjacent to the first opening, the first loop-securing structure movable from an open position to a closed position such that the first loop-securing structure in a closed position defines a third opening. In some embodiments, the buoy further includes a second loop-securing structure comprising a third plate and a fourth plate, each of the third and fourth plates detachably connected to the buoyant body substantially adjacent to the second opening, the second loop-securing structure movable from an open position to a closed position, and the second loop-securing structure in the closed position defines a third opening. In some embodiments, the third opening is approximately centered over the first opening. In some embodiments, each of the first and second openings is circular. In some embodiments, each of the first and second openings is rectangular. In some embodiments, a diameter of each of the first and second openings is at least 12 inches. In some embodiments, each of the first plate and the second plate is a half-circle shape. In some embodiments, each of the first plate and the second plate is rectangular. In some embodiments, the first plate further includes a first retaining member and a second retaining member and the second plate further comprises a third retaining member and a fourth retaining member such that a first securing member is inserted into the first and third retaining members and a second securing member is inserted into the second and fourth retaining members to secure the loop-securing structure in a closed position. In some embodiments, each of the first and second securing members is a bolt. In some embodiments, the first and second securing members are removably secured with locking nuts.

In another aspect, a floating buoy for holding an anchor line having a loop at one end is disclosed. The buoy includes a buoyant body, a first opening and a second opening formed in the buoyant body, the first and second openings forming a passage through the buoyant body, and a loop-securing structure detachably connected to the buoyant body adjacent to the first opening, the loop-securing structure movable from a first position to a second position, the loop-securing structure configured to at least partially cover the first opening and the loop-securing structure configured such that in the first position it defines a third opening that is narrower than both of the first opening and the second opening. In some embodiments, the third opening is approximately centered over the first opening. In some embodiments, the buoyant body further includes a collar secured to the buoyant body such that the collar surrounds and is adjacent to the first opening. In some embodiments, the loop-securing structure further comprises a rectangular plate having angled surfaces defining a loop-securing opening in the plate, the third opening forming part of the loop-securing opening, the plate detachably secured to the collar with a plurality of mechanical fasteners. In some embodiments, the collar further includes a tab extending from the collar into the first opening such that the tab extends into the loop-securing opening when the loop-securing structure is secured to the collar. In some embodiments, the loop-securing structure further includes a first plate and a second plate hingeably attached to the first plate such that the first plate can rotate with respect to the second plate, each of the first plate and the second plate detachably secured to the collar with a plurality of mechanical fasteners. In some embodiments, the loop-securing structure further includes a first plate and a second plate, each of the first plate and the second plate hingeably attached to the buoyant body. In some embodiments, the floating buoy further includes a collar secured to the buoyant body such that the collar surrounds and is adjacent to the first opening, the collar further including a groove formed in an interior perimeter of the collar and the loop-securing structure further includes a first plate and a second plate such that the first and second plates slide from a first position to a second position within the groove.

In yet another aspect, a floating buoy for holding an anchor line having a loop at one end is disclosed. The buoy includes a buoyant body, a first opening in the buoyant body, the first opening having an area that is at least as large as twice the cross-sectional area of an anchor line, and a securing structure configured to have first and second positions, the securing structure, when in the first position, defining a securing opening, the securing opening having an area that is smaller than twice the cross-sectional area of the anchor line. In some embodiments, the floating buoy further includes a second opening in the buoyant body, the second opening having an area that is at least as large as twice the cross-sectional area of the anchor line. In some embodiments, the first opening is located on a top side of the buoy, the second opening is located on a bottom side of the buoy, and the securing opening is concentric with one of the first opening and the second opening.

Several illustrative embodiments are disclosed in this specification. Any feature, structure, or step disclosed in connection with any embodiment can be replaced with or combined with any other feature, structure, or step disclosed in connection with any other embodiment, or omitted. Further, for purposes of summarizing the disclosure, certain aspects, advantages, and features of the inventions have been described herein. However, not all embodiments include or achieve any or all of those aspects, advantages, and features. No individual aspects of this disclosure are essential or indispensable.

BRIEF DESCRIPTION OF THE DRAWINGS

Various embodiments are depicted in the accompanying drawings for illustrative purposes, and should in no way be interpreted as limiting the scope of the embodiments or inventions. Furthermore, any features, structures, components, materials, and/or steps of different disclosed embodiments can be combined to form additional embodiments, which are part of this disclosure.

DETAILED DESCRIPTION OF THE PREFERRED EMBODIMENT

Various embodiments of floating anchor cans or buoys are disclosed. The inventions disclosed herein are described in the context of floating anchor cans (also called anchor cans, anchor buoys, buoys, or otherwise) because they have particular utility in this context. However, the inventions disclosed herein can be used in other contexts as well, such as in any other type of floating buoy. Further, although the features described herein refer to various example embodiments and drawings, other variations and improvements may be included, used, or substituted in view of these teachings without deviating from the scope and spirit of the invention.

Figure 1:
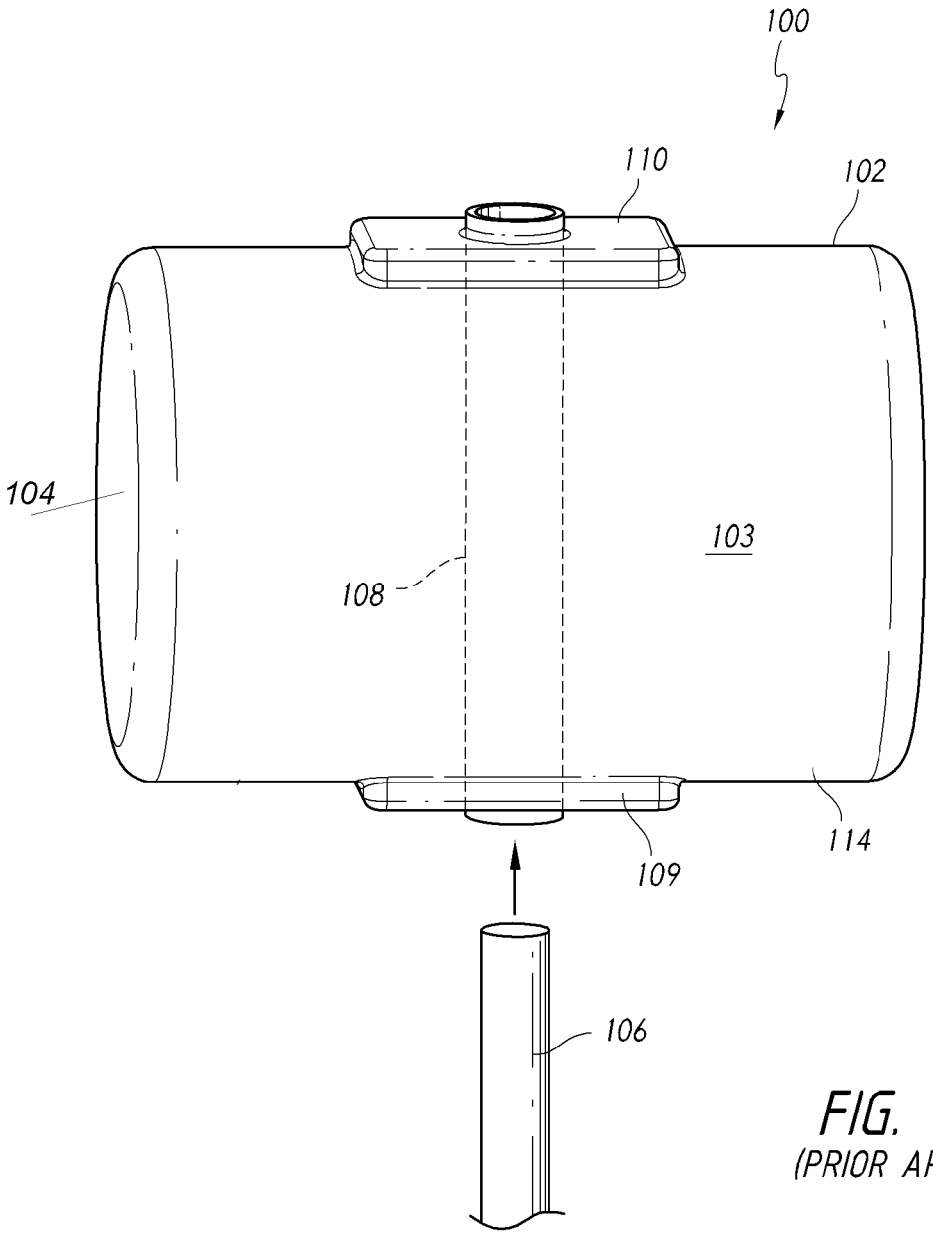
FIG. 1 (PRIOR ART)
FIG. 1 schematically illustrates a prior art floating anchor buoy and wire rope assembly.

FIG. 1 schematically illustrates some components of a floating anchor can or buoy assembly 100 according to the prior art. As shown, the buoy assembly 100 can include a cylindrical can 102. The can 102 may be hollow, with at least one end 104. The end 104 may be welded to cylindrical surface 103 of the can 102. The can 102 may be cut such that a cylindrical member or pipe 108 may be inserted within the can 102 such that the cylindrical member 108 creates a cylindrical opening from a first, top side of the can 102 to a second, bottom, or opposite side of the can 102 located approximately 180 degrees from the first side of the can. The cylindrical member 108 may be welded to the can 102 at both the top side and the bottom side to form an air-tight compartment 114 in the can 102. In some embodiments of the prior art, a larger opening may be cut in top and bottom sides of the can 102.

Figure 2:
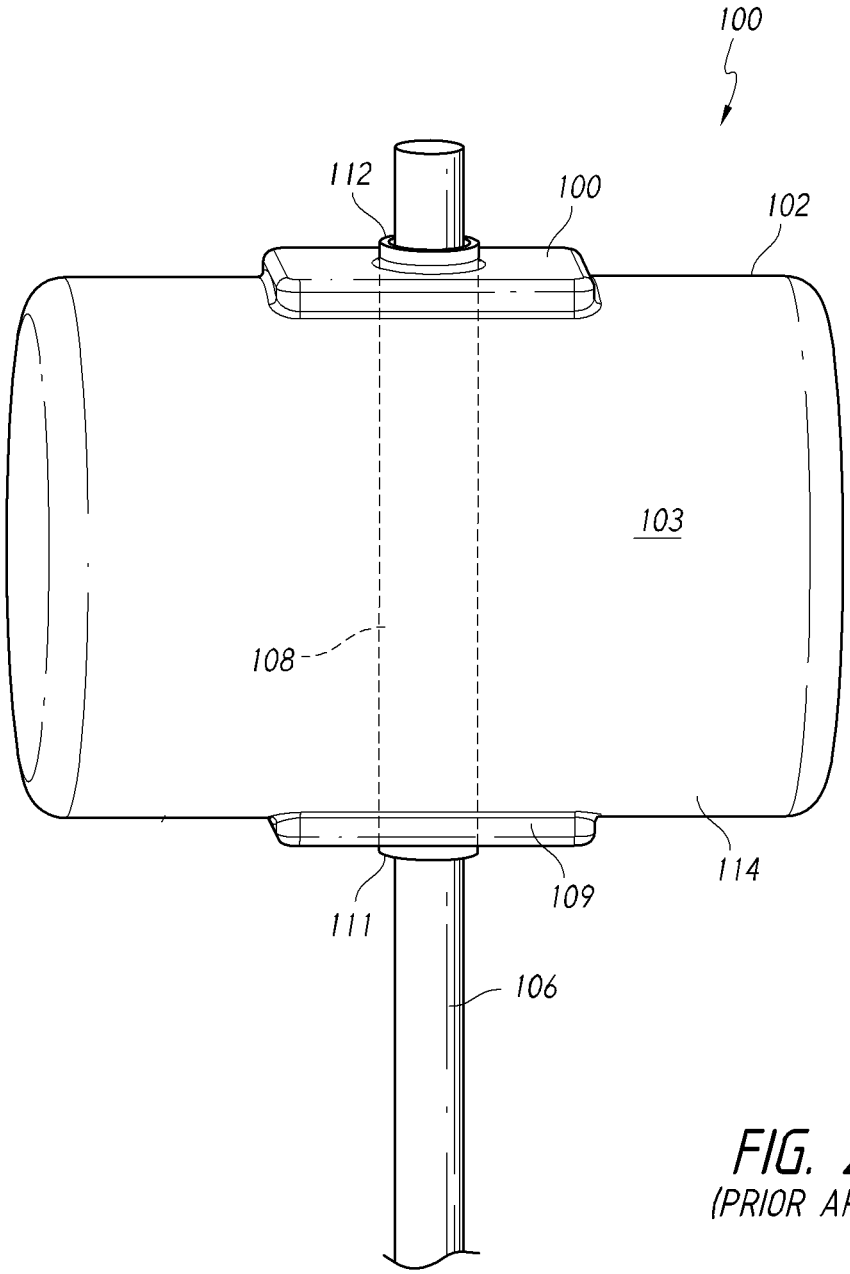
FIG. 2 (PRIOR ART)
FIG. 2 schematically illustrates the floating anchor buoy shown in FIG. 1 with the rope passed through the anchor can.

Plates 109, 110 each having an opening for the pipe 108 may be welded to the bottom and top sides of the can 102 and to the external circumference of the pipe 108, as shown. A wire rope or cable 106 may be passed through the pipe 108 from one side of the can 102 to the other, for example, through the bottom end 111 of the pipe 108 and emerging from the top end 112 of the pipe 108, as illustrated in FIG. 2.

Figure 3:
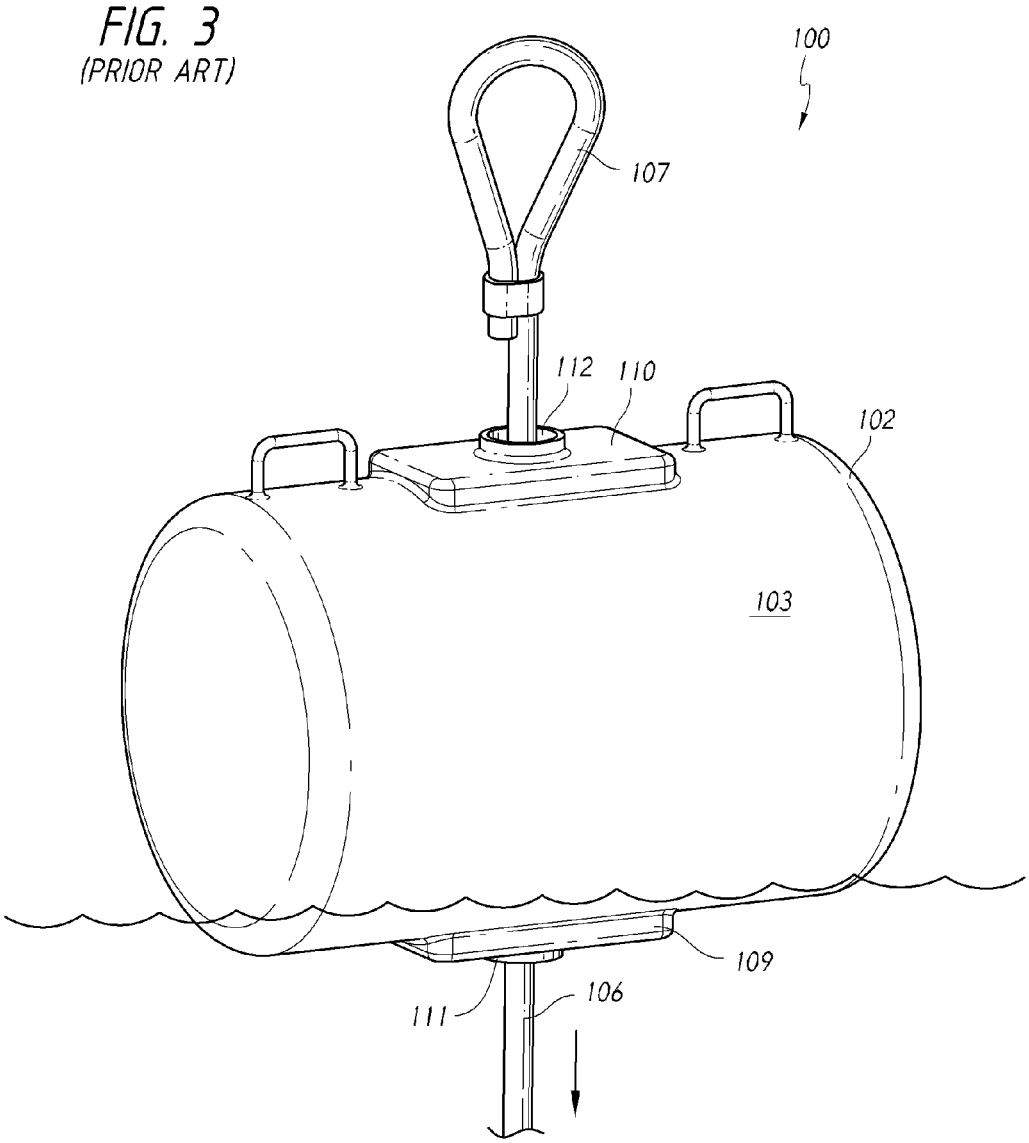
FIG. 3 (PRIOR ART)
FIG. 3 schematically illustrates the floating anchor buoy shown in FIGS. 1 and 2 floating on the surface of the water and securing a wire loop above the surface of the water.

Once one end of the wire rope or cable 106 has passed through the can 102, the wire rope 106 is spliced into a loop 107 as illustrated in FIG. 3. The loop 107 has a larger diameter than the opening of the pipe 108 and cannot fall through the can 102. This arrangement secures the loop 107 on one side of the can 102, as shown in FIG. 3. The opposite end of the wire rope or cable 106 may be attached to an anchor (not shown) so that the anchor can be easily picked from the subsurface and moved to a new location. This process is both time consuming and dangerous due to the weight of the components and the possibility of injury when splicing the heavy wire cable.

Figure 4:
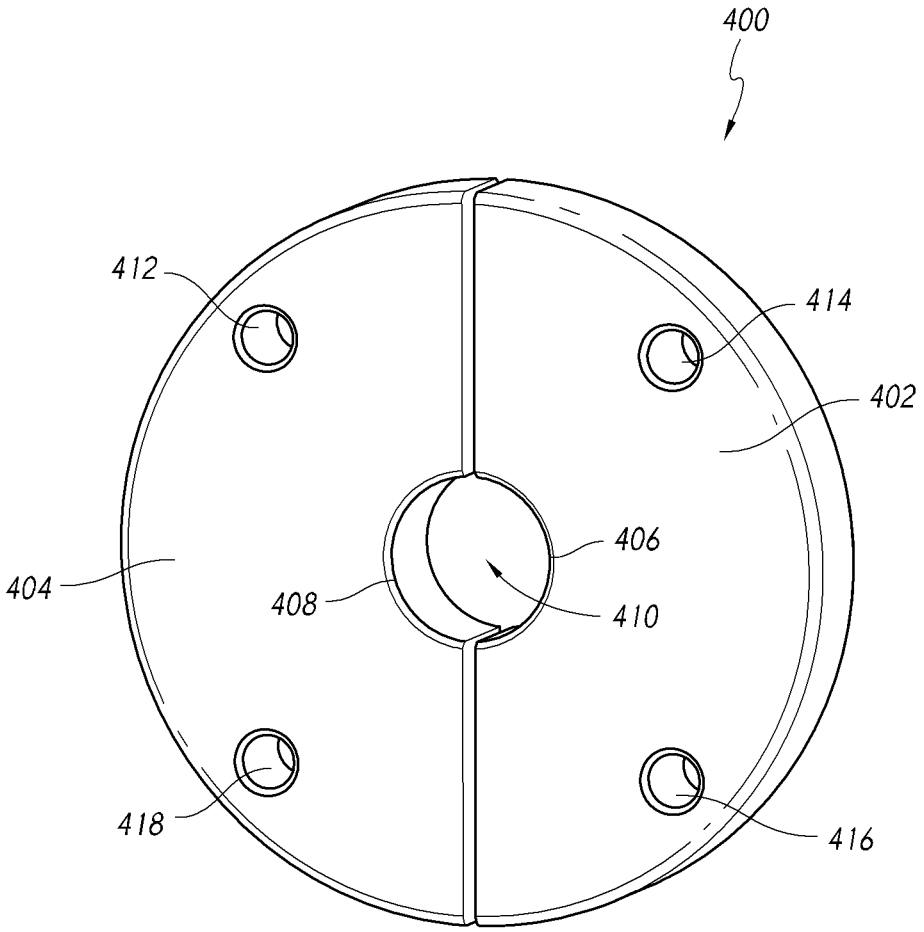
FIG. 4 schematically illustrates a loop-securing structure for an anchor buoy, according to one embodiment.

FIG. 4 illustrates one embodiment of a loop-securing structure for a floating anchor can or buoy that has advantages in safety, use and assembly over previous loop-securing solutions. A loop-securing structure 400, according to one embodiment, may include two half-circle shaped plates 402, 404. Each of the plates 402, 404 includes a curved surface 406, 408. The curved surfaces 406, 408 form an approximately circular opening 410 when the plates 402, 404 are placed together to form a circle as shown in FIG. 4. The opening 410 has a diameter of approximately 1.5" to 3" such that a wire cable having a diameter of approximately 2" can fit within the opening 410. It will be readily understood that the plates may be formed to create circular openings of a particular diameter to accommodate the diameter of a particular cable and the invention is not limited by any range of diameters. In some embodiments, the opening 410 has a diameter of between approximately 1.25" and 1.125". In some embodiments, the opening 410 has a diameter between approximately 0.5" and 2", between approximately 0.75" and 1.75", and between approximately 1" and 1.5".

Figure 5:
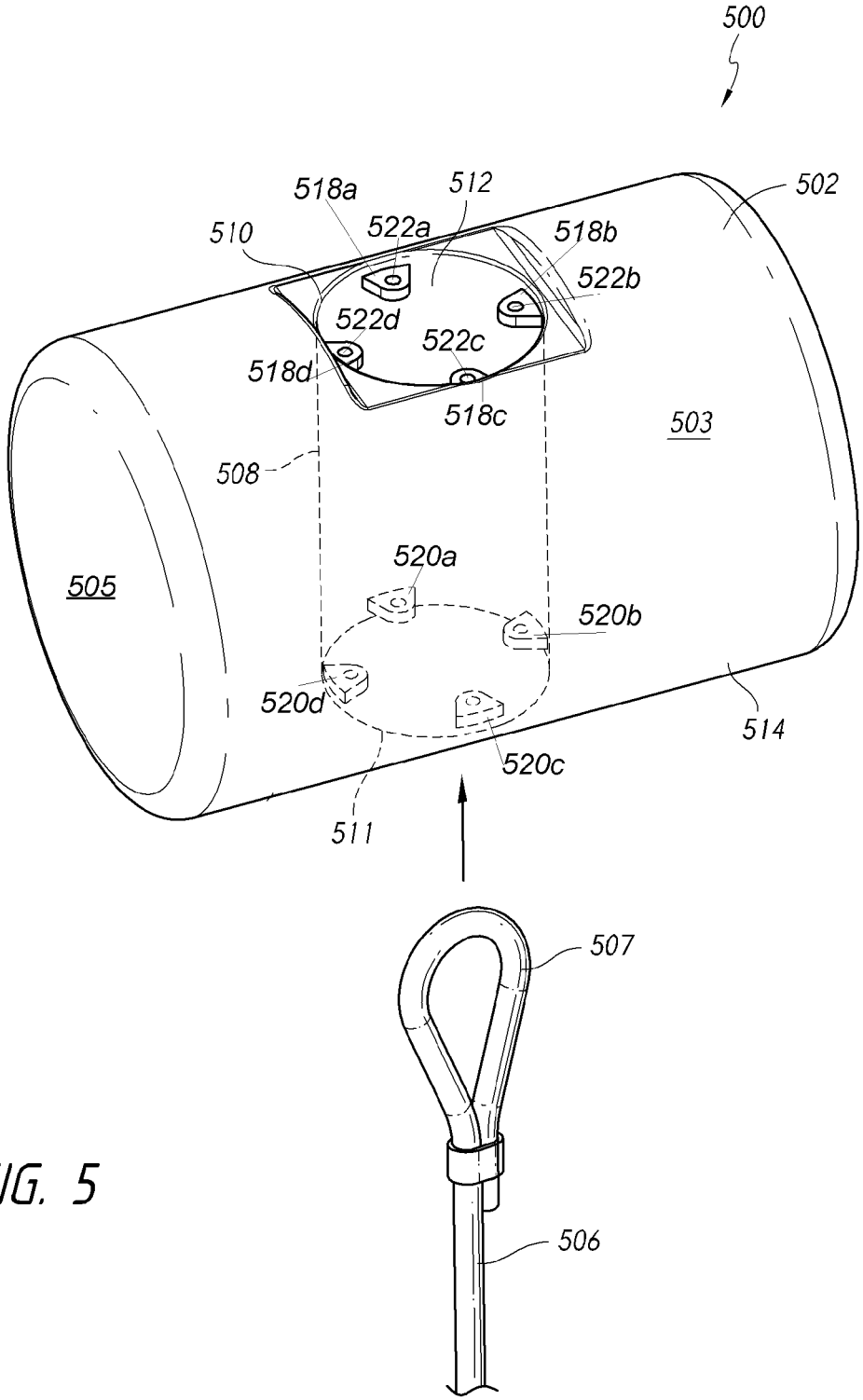
FIG. 5 schematically illustrates a floating anchor buoy according to one embodiment, the anchor buoy configured for the loop-securing structure shown in FIG. 4.

When placed side by side to form a circle and the opening 410, the plates 402, 404 form a circle having a diameter of approximately 18-20" in some embodiments. In other embodiments, the plates 402, 404 may form a circle having a diameter of approximately 10-12". In some embodiments, the plates 402, 404 may be formed from steel or another rigid material perhaps having anti-corrosion properties. In some embodiments, the plates 402, 404 may be formed from stainless steel or composite plastic. In some embodiments, a thickness or depth of the plates 402, 404 may be approximately ½". In other embodiments, the plates 402, 404 may each have a thickness of up to ½", up to ⅝", or up to ¾". The plate thickness may also be smaller or larger than these embodiments. Preferably, the plates 402, 404 are configured to be fitted to or cover a hole or opening in the anchor can that has a much larger diameter or width than the diameter of the wire cable. Furthermore, the plates 402, 404 are desirably configured to cover a hole or opening in the anchor can that has a diameter or width to allow a loop 507 formed at one end of a wire cable to pass through such opening 510, as shown in FIG. 5. Each of the plates 402, 404 may further include a plurality of bolt openings, such as bolt openings 412, 414, 416, 418 illustrated in FIG. 4. The bolt openings 412, 414, 416, 418 may be used to secure the plates to the anchor can as discussed in further detail below. While the plates 402, 404 are shown as half circles, the plates 402, 404 may also be generally rectangular, square, or half-elliptical shaped. It will be understood that the plates may be of virtually any shape that suffices to cover a loop-accommodating opening in the buoy and that creates, when the plates are put together, an opening just slightly larger than the diameter of a wire cable and so prevent the loop from passing through the opening.

As illustrated in FIG. 5, the anchor can assembly 500 may include a floating anchor can or buoy 502. In some embodiments, the anchor buoy 502 may be cylindrical, having an outside surface 503 and two side surfaces (one side surface 505 is illustrated). The side surfaces may be welded to the cylindrical outside surface 503. While a cylindrical anchor can is illustrated in the figures, any other shape may be used, such as spherical, rectangular, or bowl-shaped wherein one side is flat and the opposite side is curved. Openings 510, 511 may be cut in the top and bottom sides of the buoy 502 approximately 180 degrees apart in the surface 503 such that a cylindrical member or pipe 508 may be inserted within the can 502 to form a passage 512 through the anchor can 502. The cylindrical member 508 may be formed from a pipe or from sheet metal formed into a cylindrical shape. The cylindrical member 508 may be welded or otherwise secured to the buoy 502 at the openings 510, 511. In some embodiments, the passage 512 may have a diameter of approximately 18-20". In other embodiments, the passage 512 may have a diameter of approximately 10-12". In some embodiments, the passage 512 may have a diameter of at least 10", at least 15", at least 18" or at least 20". In some embodiments, the passage 512 may have a maximum diameter of 12", a maximum diameter of 15", or a maximum diameter of 20". FIG. 5 illustrates a cylindrical-shaped member 508; however, in other embodiments, the passage 512 through the buoy 502 may be formed from two oppositely spaced elliptical, square, rectangular, or other shaped openings. In some embodiments, the opening 510 on the top side can 502 may be different in shape from the opening 511 on the bottom side of the can 502, such as a circular opening on the top side and a rectangular or square opening on the bottom side.

Desirably, the cylindrical member 508 divides the can 502 to form a sealed compartment 514 as shown in FIG. 5. The sealed compartment 514 is desirably filled with air and waterproof. In some embodiments, the cylindrical member 508 may be formed by a pipe, tube, or other hollow structure that can be welded or sealed to the can 502 at the openings 510, 511 to prevent water from penetrating into the compartment 514 of the buoy 502 during use.

In some embodiments, a plurality of tabs may be welded to the circumference of the openings 510, 511 to provide points of attachment for the plates 402, 404. As shown in FIG. 5, tabs 518*a-d* may be welded in an approximately symmetric pattern around the circumference of the opening 510. Similarly, tabs 520*a-d* may be welded in an approximately symmetric pattern around the circumference of the opposite opening 511. As illustrated, the tabs 518*a-d* and 520*a-d* extend into the passage 508; however, tabs 518*a-d* and 520*a-d* do not prevent a loop 507 of wire cable 506 from passing through the openings 510, 511, and passage 512. While four tabs are illustrated in FIG. 5, it will be understood that any number of tabs may be used to secure the plates to the buoy 502 as long as the openings 510, 511 remain wide enough to accommodate a looped wire cable, at a minimum wide enough to accommodate two diameters of a wire cable.

Figure 6:
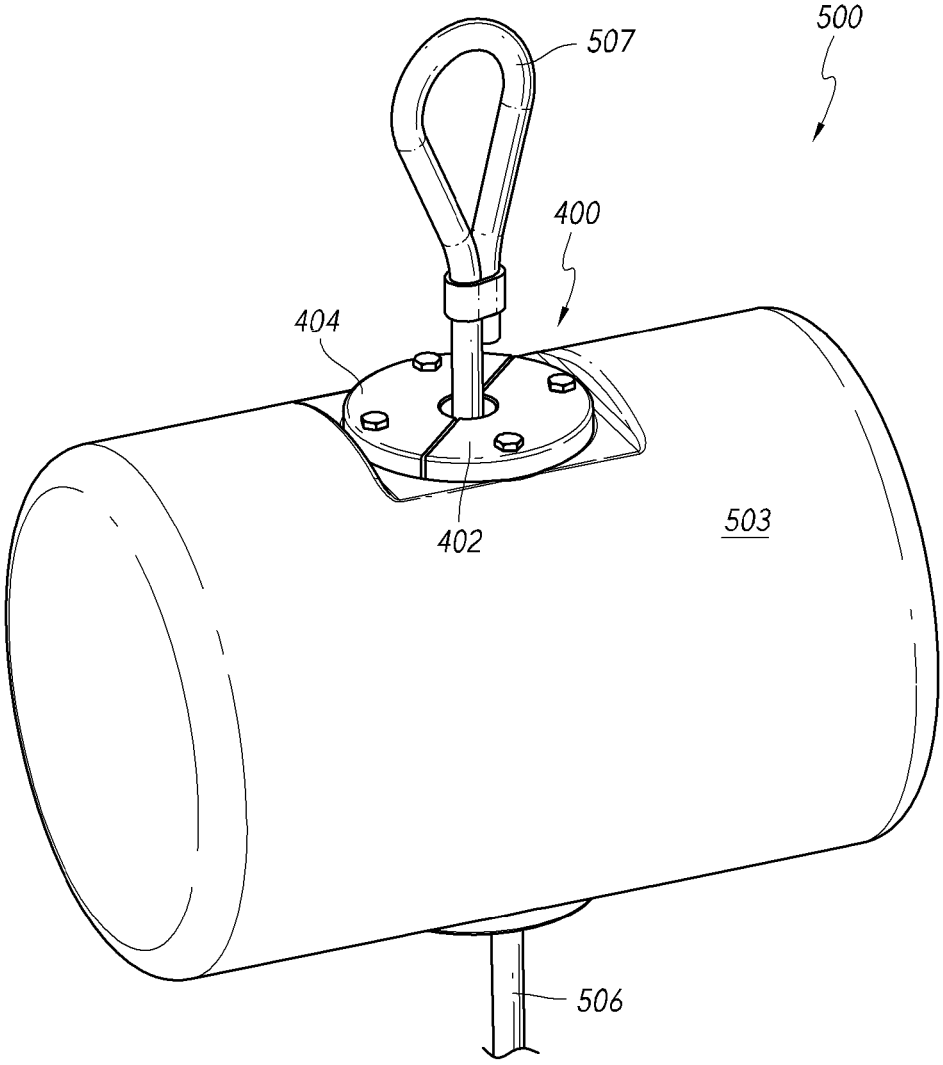
FIG. 6 schematically illustrates the floating anchor buoy shown in FIG. 5 with a loop-securing structure attached.
Figure 7:
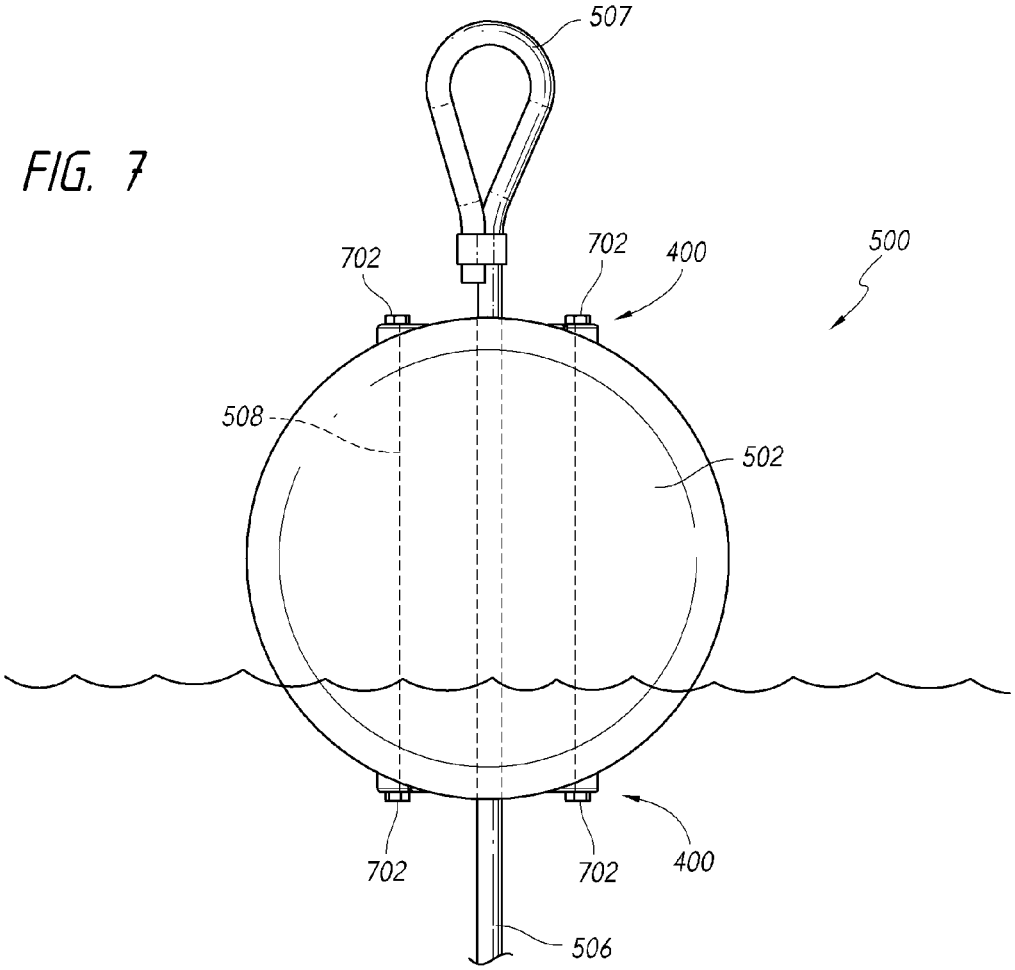
FIG. 7 schematically illustrates a side view of the floating anchor buoy and loop-securing structure shown in FIG. 6.

FIGS. 6 and 7 illustrate one embodiment of a fully-assembled buoy and loop-securing structure 500. Desirably, the wire cable 506 is pre-looped, either by splicing, crimping, or other means, before the loop 507 is passed through the buoy 502 via the passage 512 shown in FIG. 5. As discussed above, the openings 510, 511 have a width or diameter large enough to accommodate the loop 507 such that the loop 507 can be easily passed through the passage 512. Once the loop 507 has been passed through the passage 512 and the loop 507 extends from a top or bottom side of the buoy 502 above the surface 503 of the buoy 502, the plates 402, 404 may be positioned to encircle the wire cable 506 and secured to the buoy 502. The bolt openings 412, 414, 416, 418 of the plates 402, 404 preferably align with receiving members 522*a-d* (shown in FIG. 5) on the tabs 518*a-d* to cover the opening 510 and form an opening just slightly larger than the diameter of the wire cable 506. A second set of plates 402, 404 may be used to similarly secure the opening 511 and form an opening just slightly larger than the diameter of the wire cable 506, with bolt openings 412, 414, 416, 418 preferably aligned with receiving members on tabs 520*a-d*. The receiving members may be nuts configured to receive a bolt or other mechanical fastener that is passed through the bolt openings 412, 414, 416, 418, such as bolts 702 shown in FIG. 7. In some embodiments, the receiving members and bolt openings 412, 414, 416, 418 may be configured for ½" bolts. In other embodiments, the receiving members and bolt openings 412, 414, 416, 418 may be configured for bolts or mechanical fasteners of other sizes, such as ¼", ⅝", ¾", etc. Desirably, the sets of plates 402, 404 are secured to the buoy 502 such that diameter of the opening 410 formed when the plates are put together allows the wire cable 506 to move freely through the passage 508 while securing the loop 507 from falling through the passage 508, as shown in FIGS. 6 and 7. Two loop-securing assemblies 400 are illustrated in FIGS. 6 and 7 with one loop-securing structure on a top side of the buoy 502 and a second loop-securing structure on a bottom side of the buoy 502. It will be understood that in some embodiments a single loop-securing structure, such as assembly 400, may be used on either the top or bottom side of the buoy 502. In other embodiments, the loop-securing structure 400 may be used to restrict the diameter of the passage 512 at any point along its length between opening 510 and opening 511.

Figure 8:
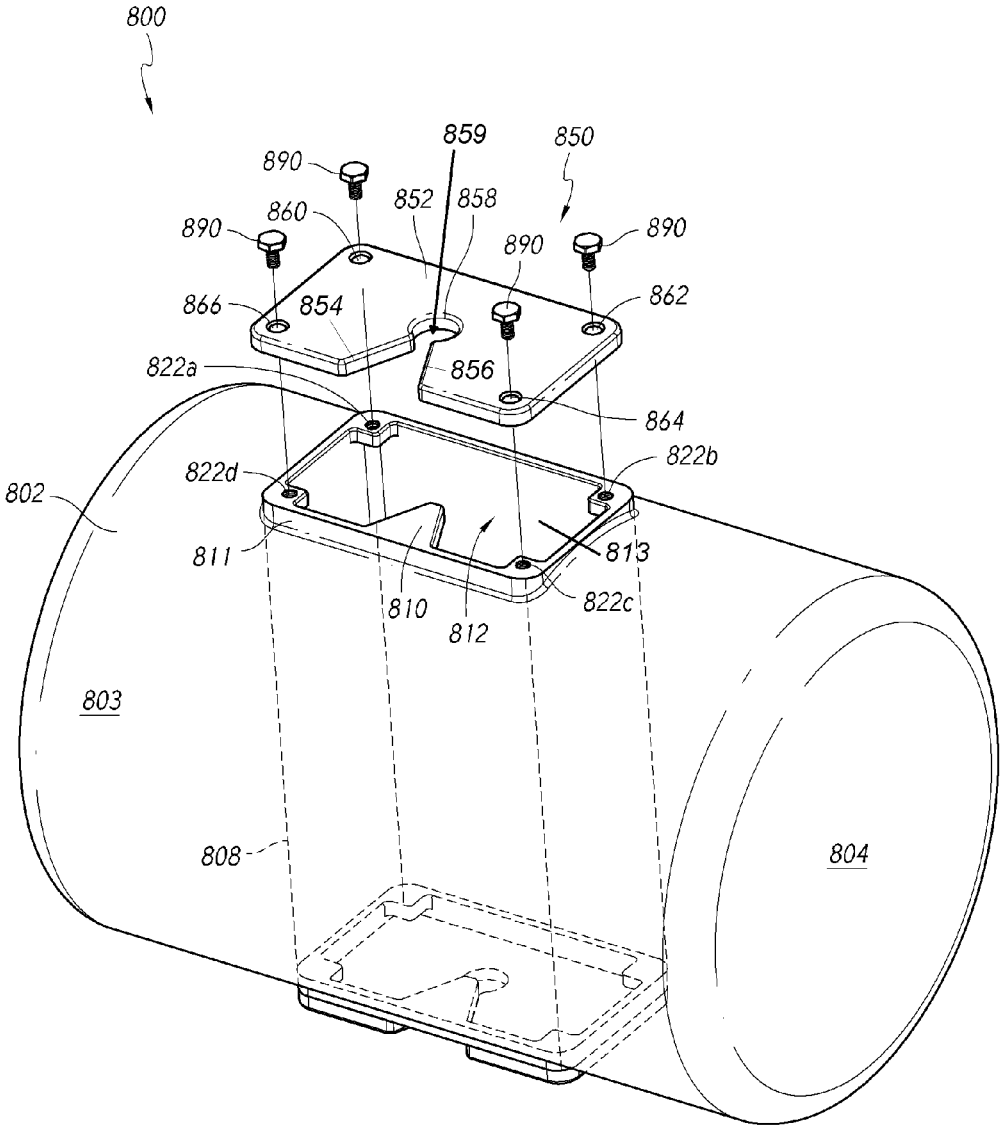
FIG. 8 schematically illustrates a floating anchor buoy and loop-securing structure according to another embodiment.

Another embodiment of a floating buoy and loop-securing structure 800 is shown in FIG. 8. The floating buoy 802 is similar in construction to the buoy 502 discussed above. The buoy 802 is shown as a cylinder but in other embodiments the buoy 802 may be any other shape including spherical, bowl-shaped, etc. In the embodiment shown in FIG. 8, an opening 813 may be cut or formed in the surface 803 of the buoy 802. The opening 810 as illustrated is a rectangular opening; however, it will be understood that the opening may be of any shape that can accommodate the passage through the opening of a looped wire cable. While only a single opening in the buoy 802 is discussed in detail in FIG. 8, a similar opening is formed in the surface 803 of the buoy 802 on an opposite side of the buoy 802 approximately 180 degrees from the passage 812, similar to the oppositely-spaced openings discussed above with respect to FIG. 5. As discussed above, a cylindrical, square or rectangular insert 808 may be formed from a pipe or sheet metal formed to the required shape. The insert 808 may be welded to the buoy 802 at or near the openings, such as opening 813. The two openings on the top and bottom of the buoy 802, along with the insert 808, desirably form a passage 812, similar to the passage 512 discussed above.

As discussed above, the passage 812 is desirably wide enough that the wire loop can pass through the passage 812 in the buoy 802. To secure the loop of the wire cable on one side of the buoy 802, a loop-securing structure 850 is secured to the buoy 802 after the loop has been pulled through the buoy 802. The loop-securing structure includes a plate, such as plate 852, formed from steel or another rigid material. While a rectangular plate 852 is illustrated in FIG. 8, it will be understood that the plate 852 may be of virtually any shape that suffices to cover a loop-accommodating opening in the buoy and that creates, when the plate 852 is secured to the buoy 802, an opening larger than the diameter of a wire cable but small enough to prevent a loop in the wire cable from passing through the opening. In some embodiments, the plate 852 has a depth or thickness of approximately ½" though in other embodiments, the plate 852 may have a depth or thickness of approximately ⅝", ¾", etc. The plate thickness may also be larger or smaller than these embodiments. Desirably, the plate 852 has a length and width that is approximately equal to the length and width of the opening 813 such that the plate 852 can substantially cover the opening 810. The invention, however, further contemplates other plates or securing devices that restrict passage of a looped wire cable but do not fully cover the opening 810.

The plate 852, as illustrated in FIG. 8, desirably has two angled surfaces 854, 856 along one of the long sides of the rectangular plate 852. The angled surface 854, 856 are angled generally towards the center of the plate 852 as illustrated. In other embodiments, the angled surfaces may be formed along any of the other sides of the plate 852. The angled surfaces 854, 856 are joined together by a curved surface 858 to form a keyhole-shaped opening 859. The opening 859 formed by the angled surfaces 854, 856 and the curved surface 858 is desirably wide enough to allow a wire cable to pass through the opening but not wide enough to allow a cross-sectional area of a double thickness of wire cable or a pre-looped wire cable to pass through the opening.

As illustrated, the angled surfaces 854, 856 and curved surface 858 form a keyhole-shaped opening 859 in the plate 852. In other embodiments, the surfaces 854, 856 may be parallel and define a width of an opening between them that is larger than the diameter of a wire cable and is also small enough to prevent passage through the opening of a loop of the wire cable. In other embodiments, the surface 858 may be square or rectangular rather than curved. It will be understood that the opening 859 can be of virtually any shape or size that is slightly larger than the diameter of a wire cable. Additionally, plate 852 further has a plurality of holes, such as holes 860, 862, 864, 866 that may be used to secure the plate 852 to the buoy 802.

With continued reference to FIG. 8, the loop-securing structure 850 is configured to cooperate with a rectangular collar 811. The rectangular collar 811 may be welded or otherwise secured to the buoy 802. The rectangular collar 811 is desirably secured to the surface of 803 of the buoy 802 immediately surrounding the opening 813. The collar 811 desirably includes a plurality of bolt holes 822*a-d*, preferably located in each of the four corners of the rectangular collar 811. The collar 811 also preferably includes a tab 810 that extends from one side of the collar 811 into the opening 813. Preferably, the tab 810 aligns with the opening 859 created by the angled surfaces 854, 856 of the plate 852 such that when the wire cable fits within the opening 859 in the plate 852 created by the curved surface 858, the wire cable is secured within the opening 859 by the tab 810 when the plate 852 is secured to the buoy 802, as shown in FIG. 8. Bolts 890 may be used to secure the plate 852 to the collar 811 as illustrated. In the embodiment illustrated in FIGS. 8 and 9, four bolts are used. However, in other embodiments, 3, 4, 5, 6, 7, or 8 or more bolts or other mechanical fasteners may be used to secure the plate 852 to the collars 811. Additionally, while one loop-securing structure 850 is shown in detail in FIG. 8, a second loop-securing structure similar to the loop-securing structure 850 or any of the other loop-securing assemblies disclosed herein may be used to secure the wire cable extending through the opening on the opposite side of the buoy 802.

Figure 9:
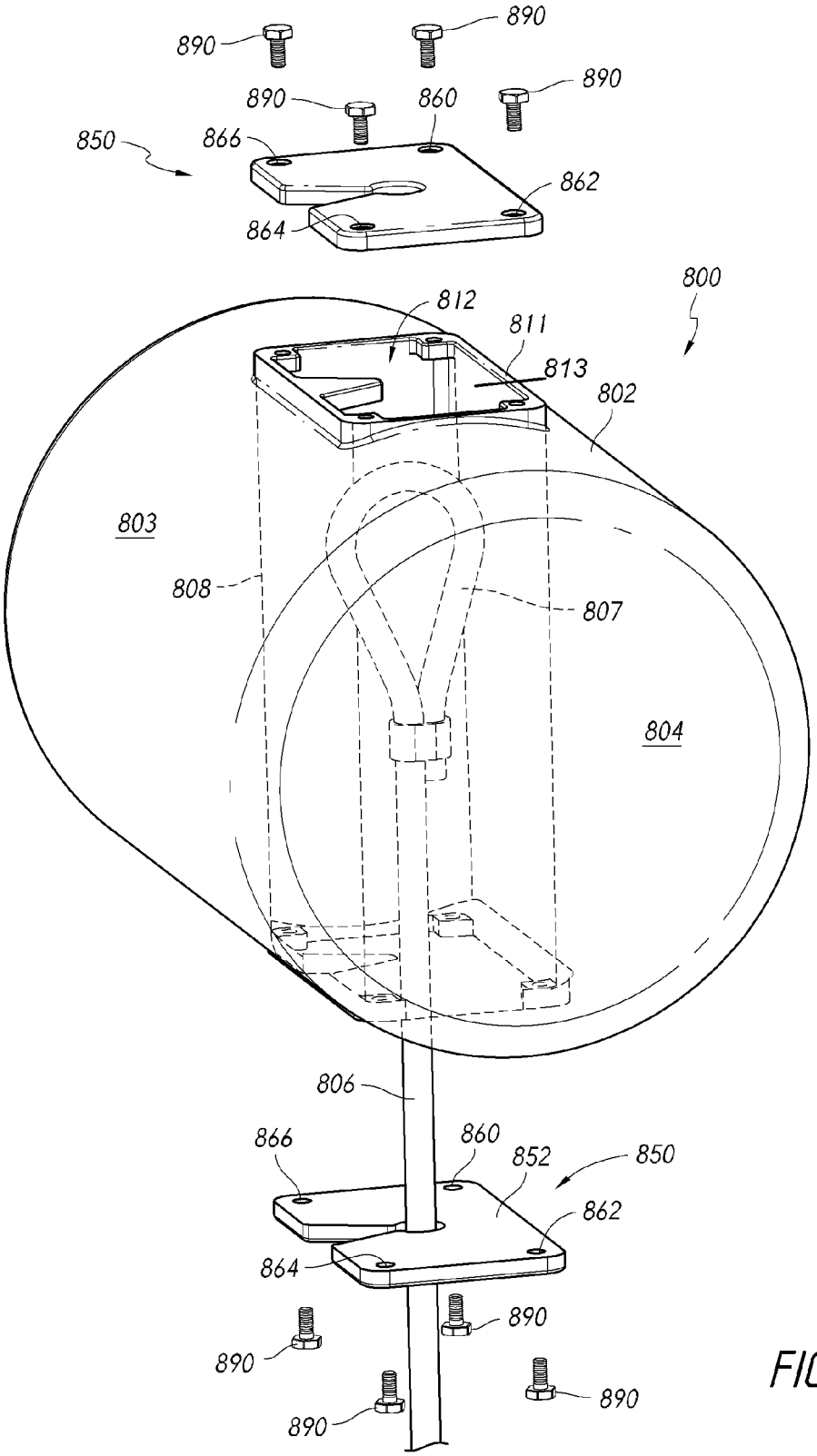
FIG. 9 schematically illustrates a side view of the floating anchor buoy and loop-securing structure shown in FIG. 8.
Figure 10:
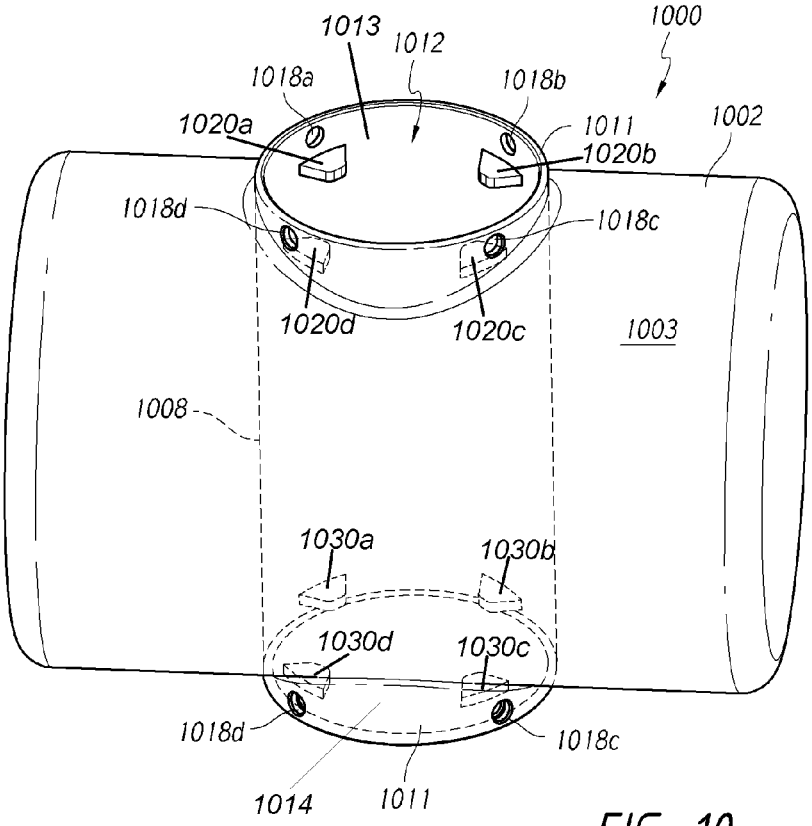
FIG. 10 schematically illustrates a floating anchor buoy according to another embodiment.

As further illustrated in FIG. 9, the opening 813 and passage 812 are large enough that at least a cross-sectional area of a double thickness of wire cable or a looped wire cable 807 can pass through. Once the wire loop 807 has passed entirely through the buoy 802 via passage 812, the plates 852 may be secured to the collars 811 to secure the wire cable 806 within the opening 859 of the plates 852. The loop-securing structure 850 desirably retains the loop 807 of the wire cable 806 on the top side of the buoy 802 while the other end of the cable 806 extends below the surface of the water to an anchor (not shown). While two loop-securing assemblies 850 are illustrated in FIG. 9, it will be understood that a single loop-securing structure may be used in some embodiments to secure the loop 807 of the wire cable 806 on the top side of the buoy 802.

Figure 11:
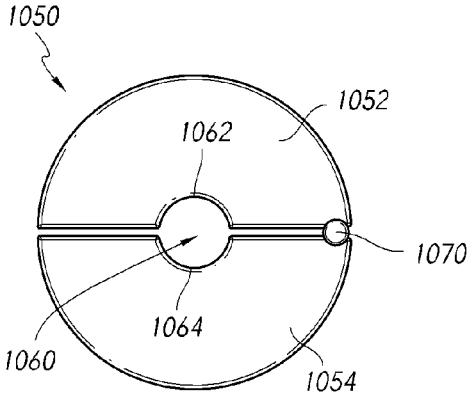
FIG. 11 schematically illustrates a loop-securing structure for the floating anchor buoy shown in FIG. 10.

Another embodiment of a loop-securing structure for a floating buoy is shown in FIGS. 10-16. The buoy 1002 is similar to the buoy 502 discussed above. The loop-securing structure 1050, illustrated in FIGS. 11 and 12, includes two half-circle or half-moon shaped plates 1052, 1054, similar to the plates 402, 404 discussed above. As discussed above, it will be understood that cooperating plates may be of virtually any shape that suffices, when the plates are put together, to create an opening just slightly larger than the diameter of a wire cable. The plates 1052, 1054 are machined to define an opening 1060. The opening 1060 may be a circular opening approximately in the middle of the two plates 1052, 1054 when the plates are joined together with the flat edges proximal each other as illustrated in FIG. 11. As discussed above, the opening 1060 has a diameter greater than the diameter of a wire cable but that is also small enough to prevent passage therethrough of a loop formed with the wire cable. In other embodiments, the opening 1060 may be rectangular, square, elliptical, or any other shape. In some embodiments, the opening 1060 may be located near the outer circumference formed by the plates 1052, 1054 when the plates are put together. The plates 1052, 1054 may be made of steel or any other strong and rigid material or other material with anti-corrosive properties with a depth or thickness measurement similar to the thicknesses discussed above with respect to the plates 402, 404. As discussed above, the plate thickness may also be smaller or larger than these embodiments.

Figure 12:
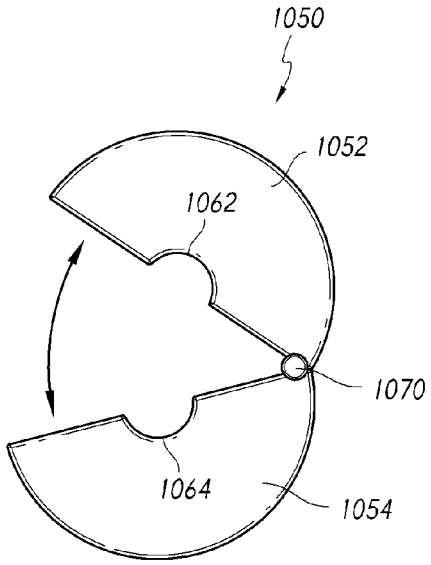
FIG. 12 schematically illustrates an open view of the loop-securing structure shown in FIG. 11.

With continued reference to FIGS. 11 and 12, the plates 1052, 1054 are desirably hinged together with a hinge 1070. The hinge 1070 may be a pin, bolt, screw, or other mechanical fastener that allows the two plates 1052, 1054 to pivot around the hinged connection. When the plates 1052, 1054 are in an open hinged configuration, such as the configuration shown in FIG. 12, a wire cable can pass between the plates 1052, 1054. When the plates 1052, 1054 are in a closed configuration, such as that shown in FIG. 11, the wire rope is desirably enclosed within the opening 1060, as will be discussed in greater detail below.

Similar to the buoy 802 discussed above, the buoy 1002 shown in FIG. 10 includes two openings 1013, 1014 that are cut in the surface 1003 of the buoy 1002 to form a passage 1012 through the buoy 1002. Similar to the insert 808 discussed above, an insert 1008 may be welded or otherwise secured to the buoy 1002 at the openings 1013, 1014 to form the passage 1012. As illustrated, the insert 1008 is cylindrical; however, it will be understood that the insert 1008 may have a square, rectangular or elliptical cross-section. The buoy 1002 includes a pair of collars 1011 that are welded or otherwise secured to the surface 1003 of the buoy 1002. Desirably, the collars 1011 surround the openings 1013, 1014 in the buoy surface 1003. As illustrated, the collar 1011 surrounds the opening 1013 on the top side of the buoy 1002. A plurality of holes 1018*a-d* may be formed in the collars 1011 to receive securing members such as bolts, to secure the loop-securing structure 1050 to the buoy 1002.

Figure 13:
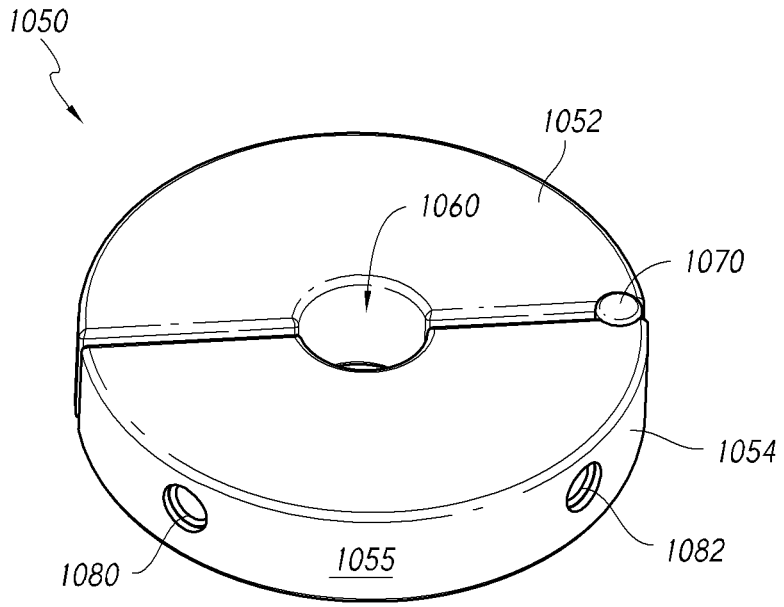
FIG. 13 schematically illustrates a perspective view of the loop-securing structure shown in FIG. 11.
Figure 14:
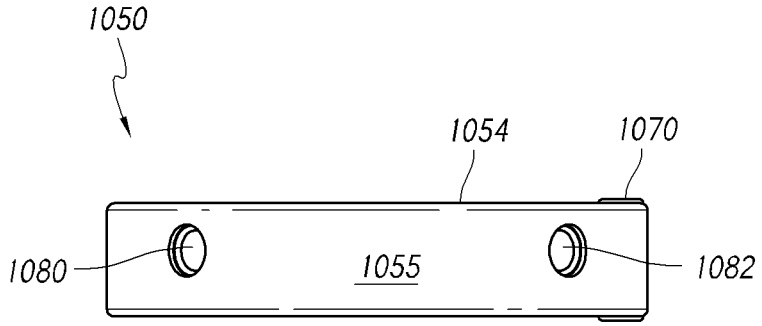
FIG. 14 schematically illustrates a side view of the loop-securing structure shown in FIG. 13.
Figure 15:
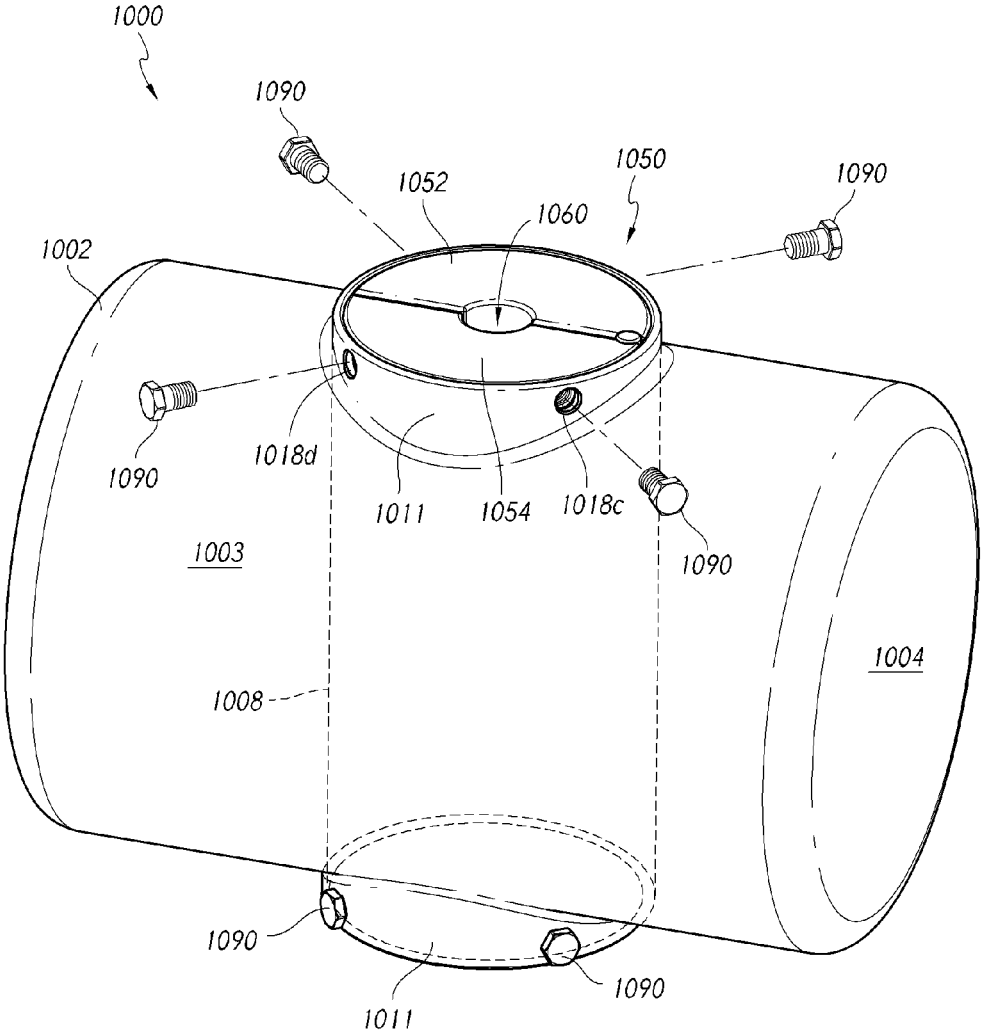
FIG. 15 schematically illustrates the floating anchor buoy shown in FIG. 10 assembled with the loop-securing structure shown in FIG. 11.

As illustrated in FIGS. 13 and 14, the plates 1052, 1054 of the loop-securing structure 1050 also desirably include a plurality of holes drilled or otherwise formed in a side surface 1055 defining the thickness of each of the plates 1052, 1054. As shown, two holes 1080, 1082 are formed in the side surface 1055 of the plate 1054. A similar set of holes (not shown) are desirably formed in the side surface of the plate 1052. The holes 1080, 1082 in plate 1054 and the pair of holes in the plate 1052 desirably align with the holes 1018*a-d* formed in the collar 1011 of the buoy 1002, as shown in FIG. 15. Bolts 1090 or other mechanical fasteners may be used to secure the hinged plates 1052, 1054 to the buoy 1002, as shown in FIG. 15.

Figure 16:
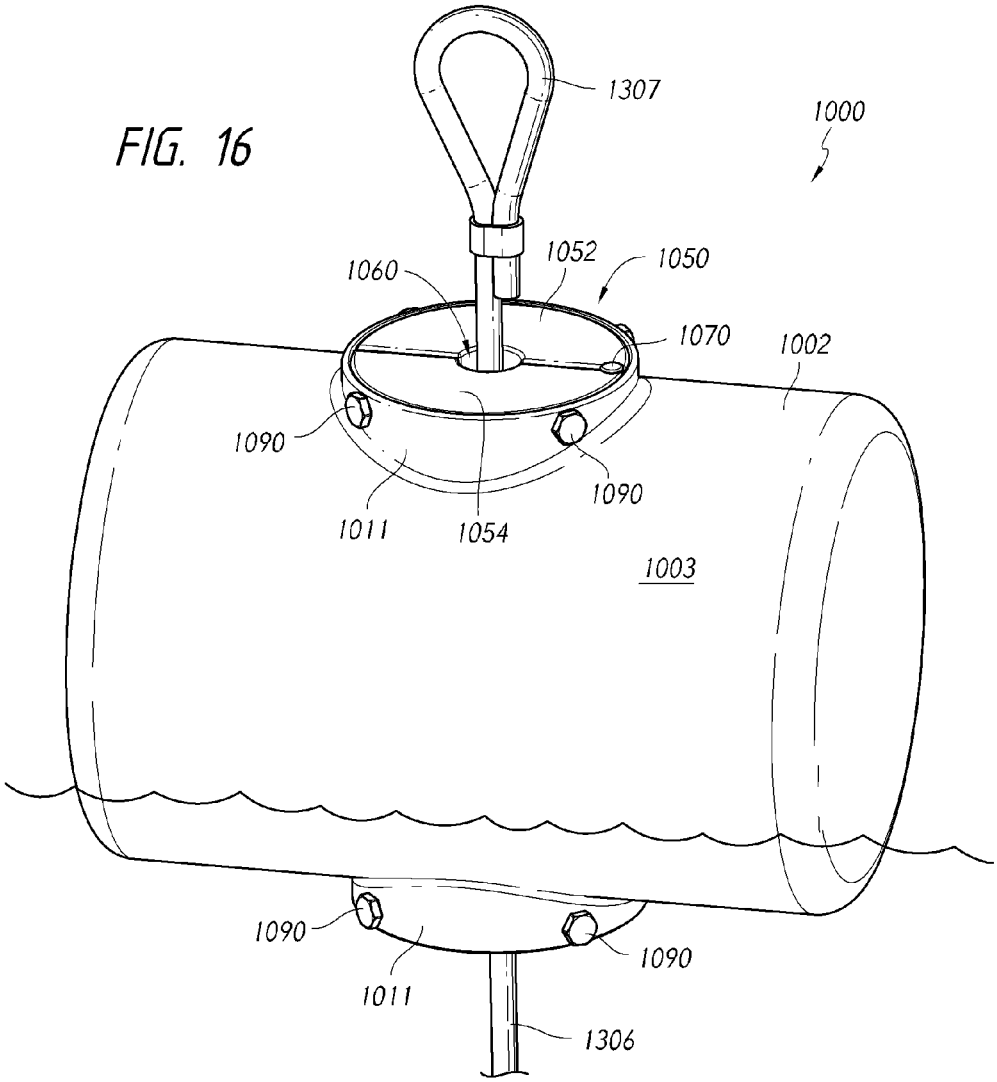
FIG. 16 schematically illustrates the floating anchor buoy and loop-securing structure shown in FIG. 15 securing a wire cable.

FIG. 16 illustrates the buoy and loop-securing structure 1000 fully assembled with a wire rope or cable 1306. As illustrated, the loop 1307 of the wire cable 1306 is retained on the top side of the buoy 1002 above the surface of the water such that it may be easily picked or captured to move the anchor attached to the other end of the cable 1306.

Figure 17:
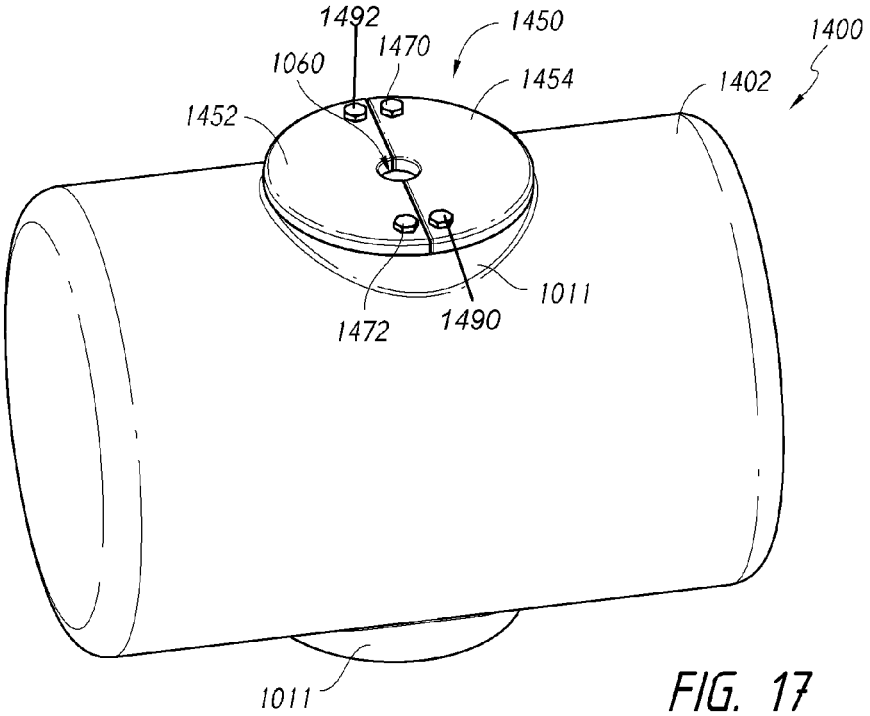
FIG. 17 schematically illustrates a floating anchor buoy and loop-securing structure according to another embodiment.
Figure 18:
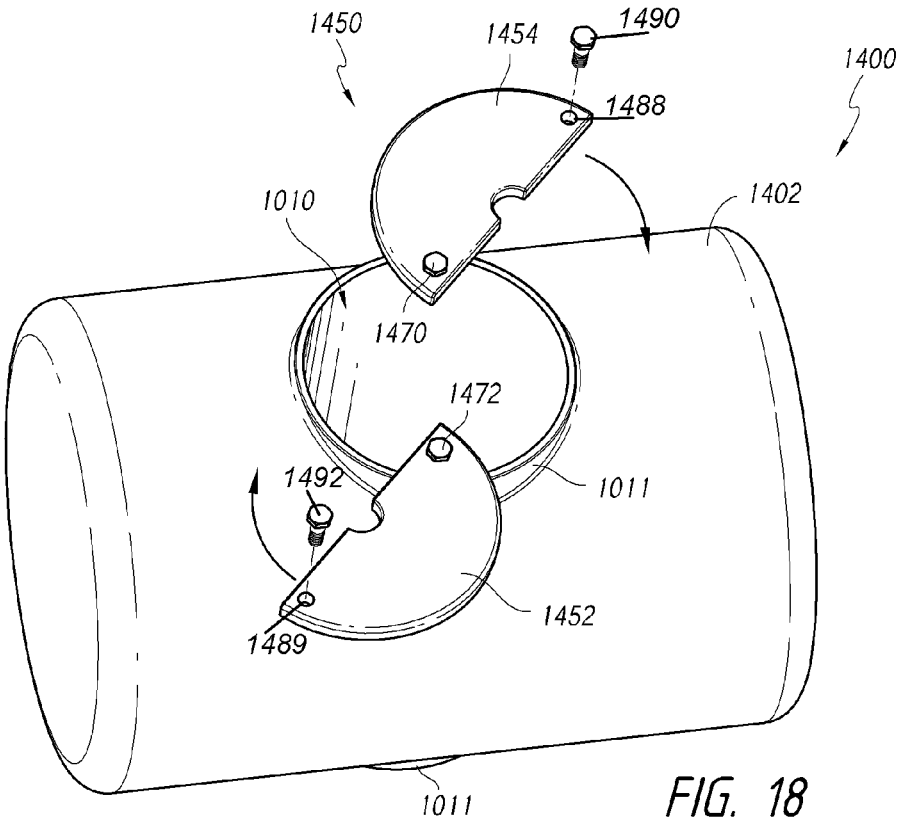
FIG. 18 schematically illustrates an open configuration of the floating anchor buoy and loop-securing structure shown in FIG. 17.

In some embodiments, the loop-securing structure may include two plates that are attached at hinge points to tabs within the collar of a buoy, as illustrated in FIGS. 17 and 18. FIG. 17 illustrates a buoy assembly 1400 that includes a loop-securing structure 1450. The loop-securing structure 1450 includes two plates 1452, 1454 that are similar to the plates 402, 404 and 1052, 1054 discussed above. The plates 1452, 1454 define an opening 1060 as discussed above. As discussed above with respect to the buoy 1002, the buoy 1402 includes a collar 1011 that is formed around or welded around openings spaced on the top and bottom sides of the buoy 1402. The openings are connected by a passage through the buoy 1402 that has a width to allow a looped cable to pass through, as has been discussed above with respect to the other embodiments.

Pins 1470, 1472 connect the plates 1452, 1454 to the buoy 1402 and form a hinged connection that allow the plates 1452, 1454 to rotate with respect to each other and to the buoy 1402, as shown in FIG. 18. The rotation of the plates 1452, 1454 allows more or less of the opening 1010 to be exposed to the external environment. When the plates 1452, 1454 are rotated to the fully open position shown in FIG. 18, the opening 1010 accommodates a pre-looped wire cable to pass through the buoy 1402. After the loop has been pulled through, the plates 1452, 1454 may be swung into a closed position, such as that shown in FIG. 17. The opening 1060, which is desirably just slightly larger than the diameter of the wire cable, encircles the diameter of the wire cable and the plates 1452, 1454 prevent the loop from passing through the buoy, as discussed above.

Figure 19:
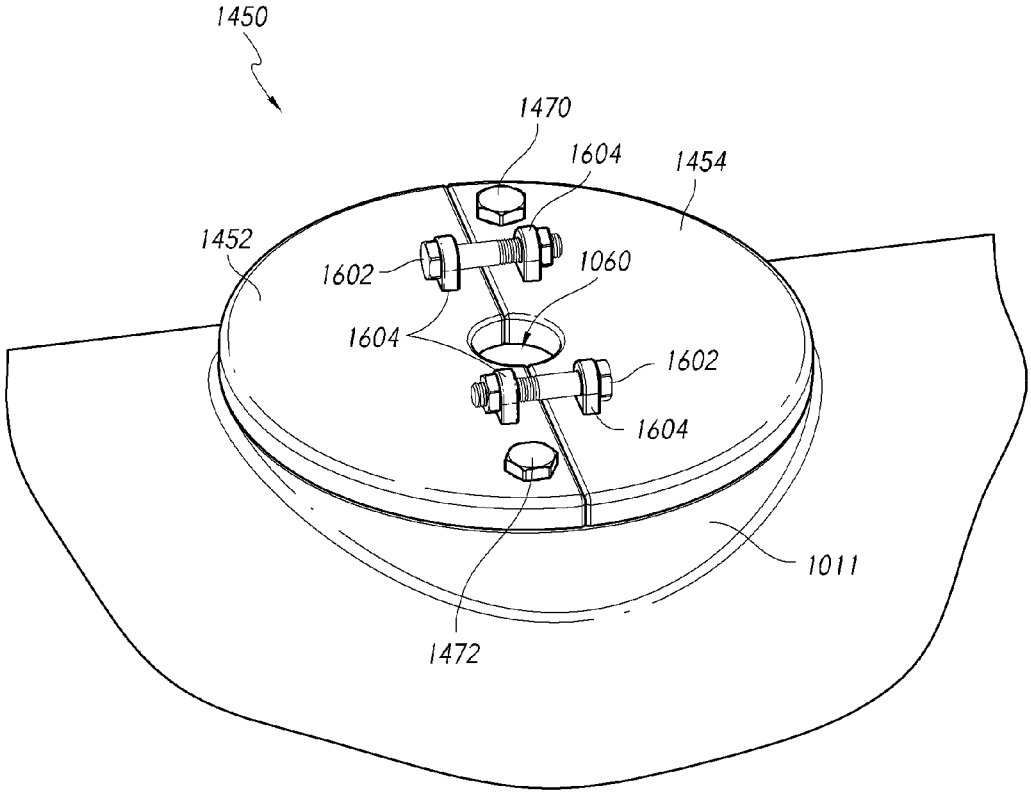
FIG. 19 schematically illustrates a securing mechanism for a loop-securing structure, according to one embodiment.

A retaining assembly of aligned and paired securing members welded to the plates 1452, 1454 may be used to easily and removably secure the plates 1452, 1454 in the closed position, as shown in FIG. 19. Securing members 1604 may be welded or otherwise secured to the plates 1452, 1454 such that a first securing member of the pair is welded to an outer surface of plate 1452 and a second securing member of the pair is welded to an outer surface of plate 1454 and the two securing members on opposite, facing plates are aligned such that a bolt 1602 can pass between them. The bolts 1602 may be secured within the securing members 1604 with lock washers, nuts or other mechanical fasteners. While FIG. 19 illustrates two bolts 1602 used to secure the plates, other mechanical securing members such as pins may be used. It will be understood that the retaining assembly illustrated in FIG. 19 may be used with any of the embodiments or alternatives discussed herein.

Figure 20:
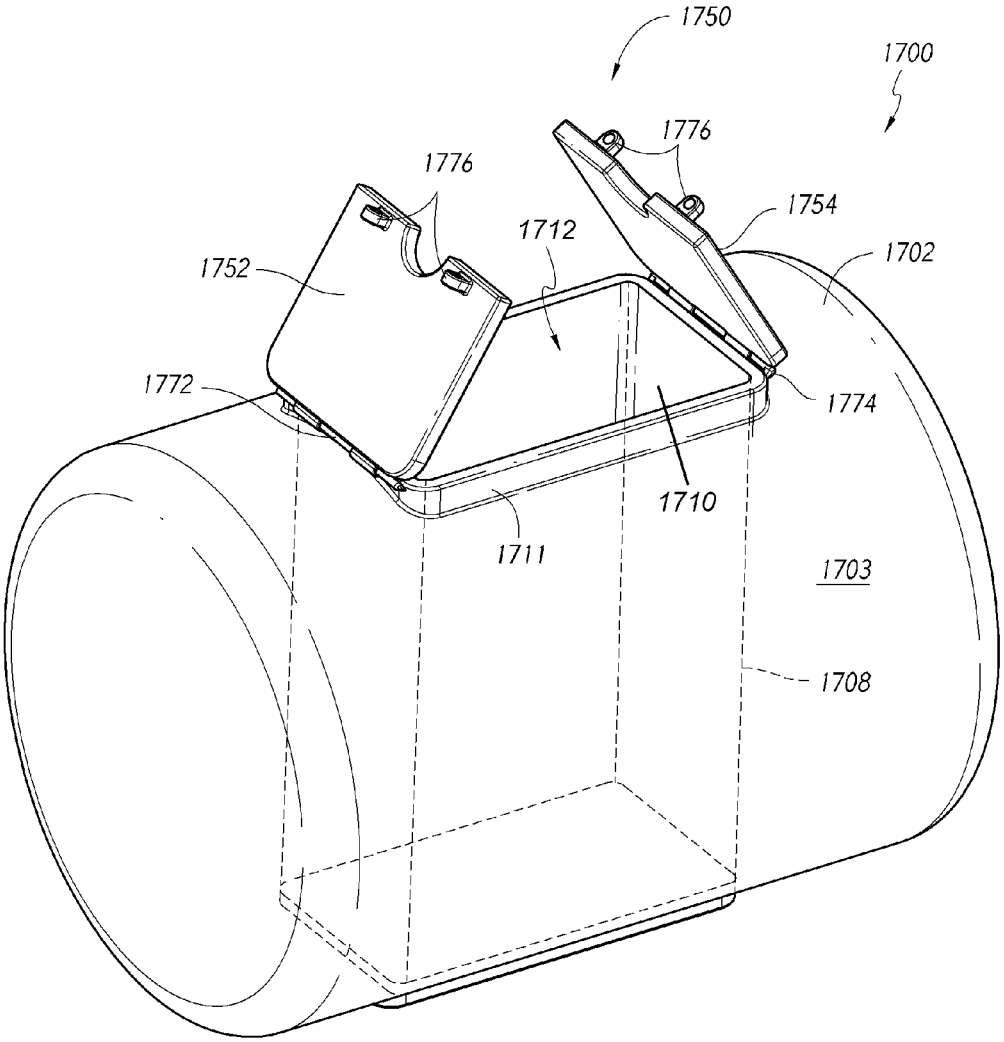
FIG. 20 schematically illustrates a loop-securing structure for a floating anchor buoy, according to another embodiment.
Figure 21:
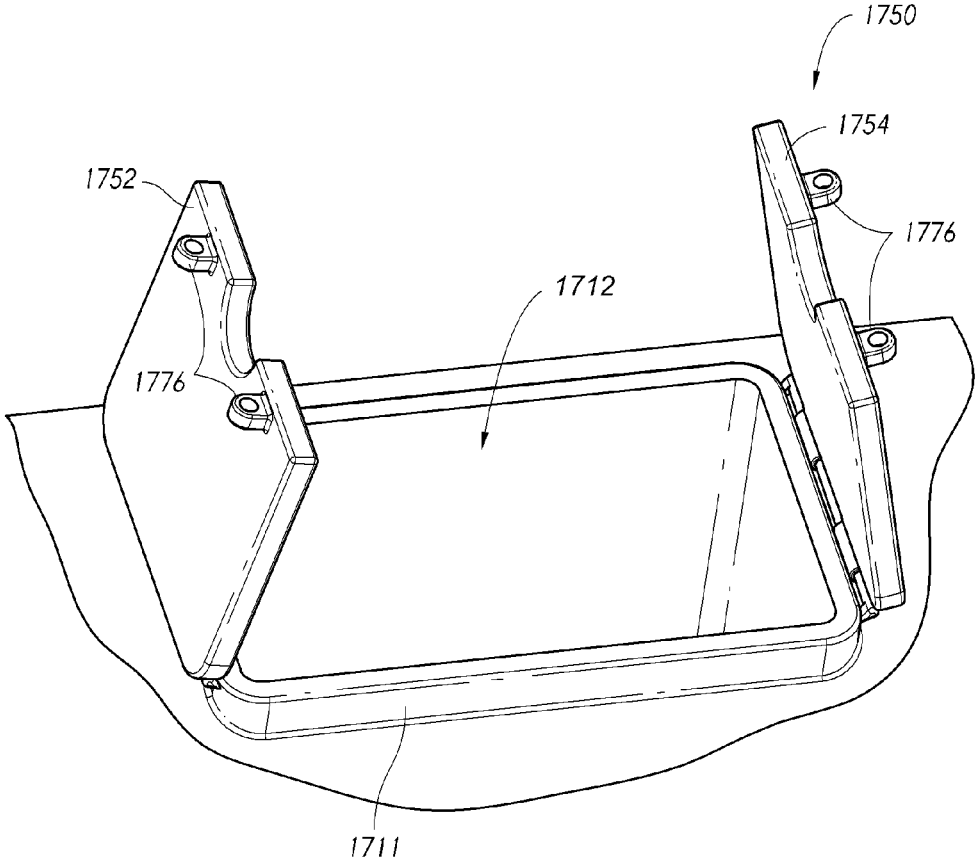
FIG. 21 schematically illustrates a closer view of the loop-securing structure shown in FIG. 20.
Figure 22:
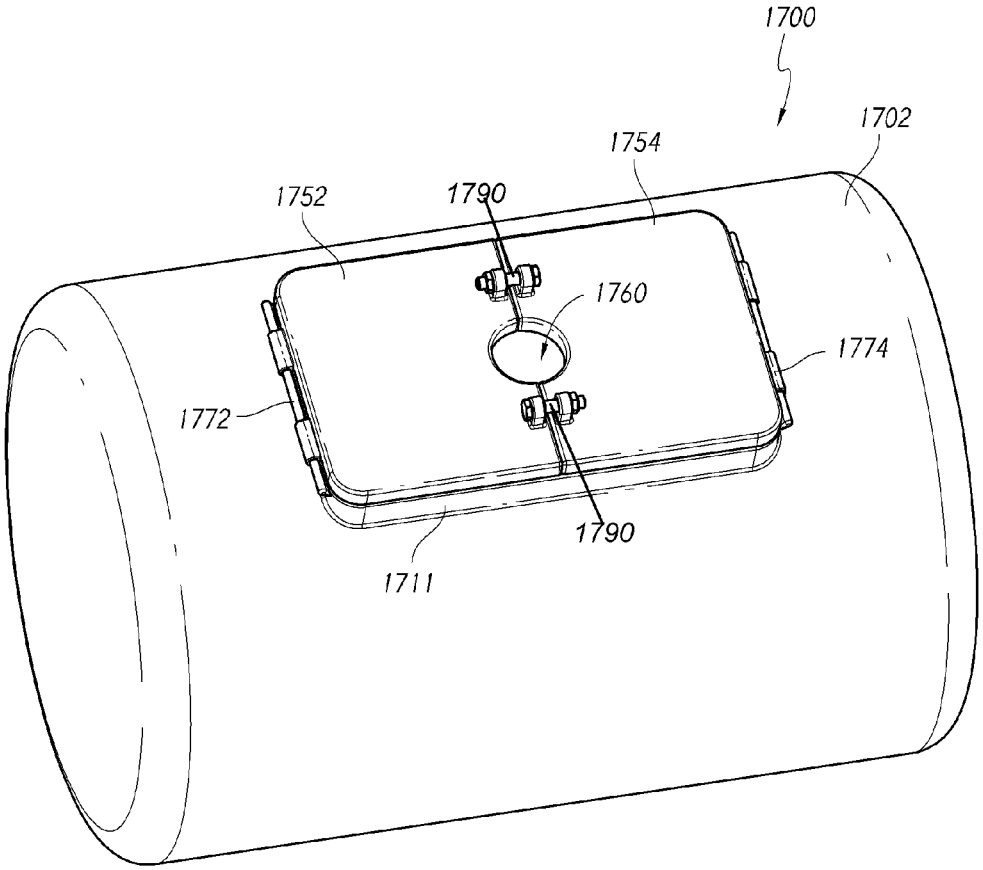
FIG. 22 schematically illustrates the loop-securing structure for the floating anchor buoy of FIG. 21 in a closed position.

FIGS. 20-22 illustrate another embodiment of a buoy assembly. The buoy assembly 1700 includes buoy 1702 that is similar to the other buoys discussed above in weight and composition. Similar to the buoys discussed above, buoy 1702 has two openings in the top and bottom sides of the buoy (one opening 1710 is illustrated) connected by a passage 1712 through the buoy 1702 with collars 1711 surrounding each of the openings 1710. While the passage 1712 is illustrated with a rectangular cross-section, the passage 1712 may have a circular, elliptical, or square cross-section, in other embodiments. Similar to the embodiments discussed above, an insert 1708 may be used to connect the openings 1710 on the top and bottom sides of the buoy 1702 such that a water-proof compartment is formed within the buoy 1702. A rectangular insert 1708 is illustrated; however, in other embodiments, the insert 1708 may have a square, circular, or elliptical cross-section, or a cross-section of any shape sufficient to accommodate a diameter of a pre-looped wire cable.

As in the embodiments discussed above, the buoy 1702 includes two openings 1710 connected by the passage 1712 through the buoy 1702. A loop-securing structure such as the loop-securing structure 1750 shown in FIGS. 20-22 may be configured to restrain a wire cable within each opening 1710 and secure a wire cable loop on one side of the buoy 1702. While only one opening 1710 on the top of the buoy 1702 is illustrated in FIGS. 20-22, the embodiments of the loop-securing structure 1750 discussed with respect to the opening 1710 may also be used to restrain a wire cable at the second, opposite, or bottom opening in the buoy 1702. The loop-securing structure 1750 includes two plates 1752, 1754. As illustrated in FIG. 20, the plates 1752, 1754 are each rectangular plates having a half-circular cut-out to define an opening 1760 for a wire cable, as shown in FIG. 22. In other embodiments, the plates 1752, 1754 may be of virtually any shape that suffices to cover a loop-accommodating opening in the buoy and that creates, when the plates are put together, an opening just slightly larger than the diameter of a wire cable.

At least one hinge member 1772, 1774 is desirably connected to the edge of each plate 1752, 1754 opposite the curves defining the opening 1760, as shown in FIG. 22. The hinge members 1772, 1774 allow the plates 1752, 1754 to swing open to expose the entirety of the opening 1710, as shown in FIG. 21. By opening to expose the full dimensions of the openings to the passage 1708, a looped wire cable can pass through the buoy via passage 1712 as discussed above with respect to the other embodiments. In other embodiments, each of the plates 1752, 1754 may be hinged on any edge other than the edge containing the curved surface defining the opening 1760.

Similar to the loop-securing structure 1450 shown in FIG. 19, retaining members 1776 may be welded or otherwise secured to the plates 1752, 1754, as illustrated in FIG. 21. A bolt 1790 or other securing mechanism such as a pin may be used to retain the loop-securing structure 1750 in the closed position, as shown in FIG. 22.

Figure 23:
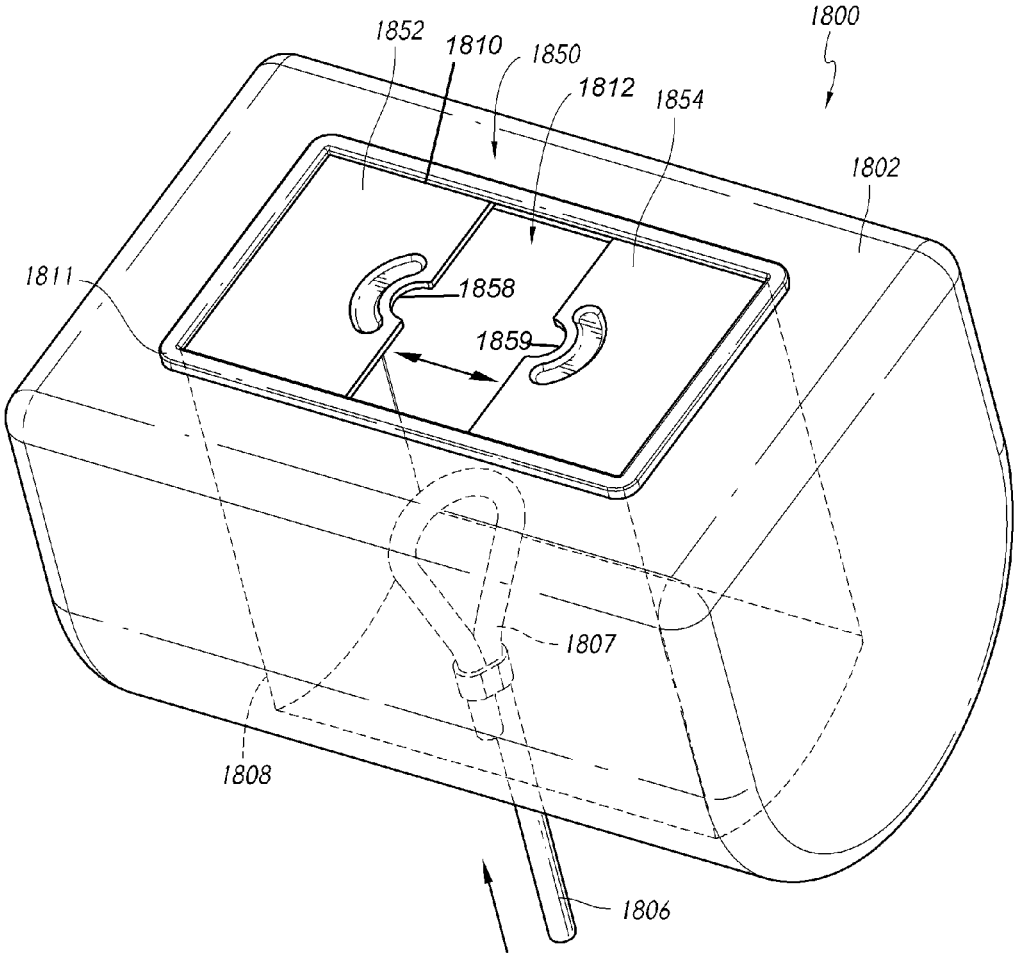
FIG. 23 schematically illustrates a loop-securing structure for a floating anchor buoy, according to another embodiment.
Figure 24:
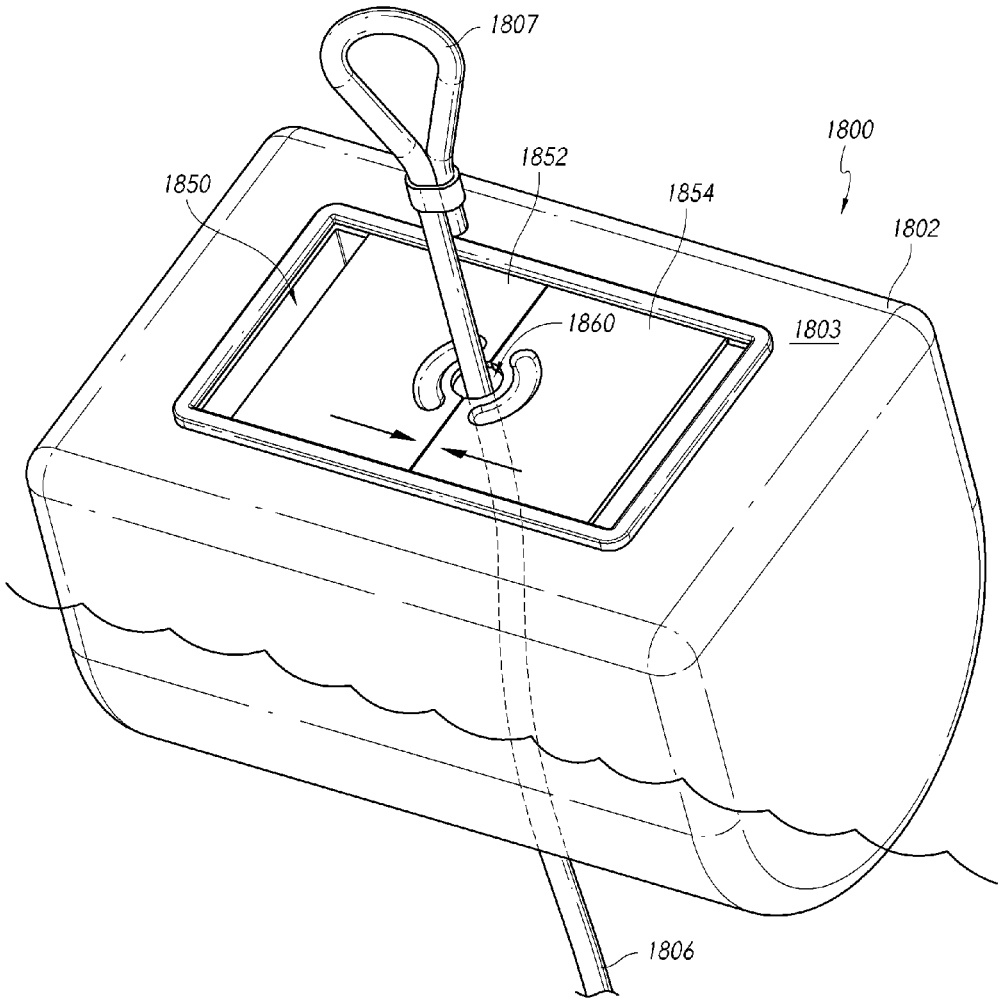
FIG. 24 schematically illustrates the loop-securing structure and floating anchor buoy of FIG. 23 securing a wire loop above the surface of the water.

FIGS. 23 and 24 illustrate another embodiment of a buoy assembly 1800. As in the embodiments discussed above, a passage 1812 is formed through the buoy 1802 to allow a looped wire cable to pass through the buoy 1802. One opening 1810 into the passage 1812 is illustrated in FIG. 23. An insert 1808 may be welded or otherwise secured to the buoy 1802 at the openings 1810 to form the passage 1812 and maintain a water-tight compartment within the buoy 1802. A collar 1811, similar to the collars discussed above with respect to the other embodiments, surrounds the opening 1810 and provides an engagement surface for the plates 1852, 1854 of the loop-securing structure 1850. The plates 1852, 1854 desirably slide within grooves formed within the collar 1811. To extend the width and height of the opening 1810 so that the pre-formed wire loop can easily pass through the opening 1810, plates 1852, 1854 of the loop-securing structure 1850 desirably slide apart. The plates 1852, 1854 desirably slide within grooves formed within the collar 1811. The plates 1852, 1854 desirably include curved cutouts 1858, 1859 that form an opening 1860. As discussed above, the plates may be of virtually any shape that suffices to create, when the plates are put together, an opening just slightly larger than the diameter of a wire cable, as shown in FIG. 24. Any type of retaining assembly, such as the aligned retaining members and bolts or pins shown in FIGS. 19 and 22 may be used to secure the plates 1852, 1854 in a closed position as shown in FIG. 24.

Figure 25:
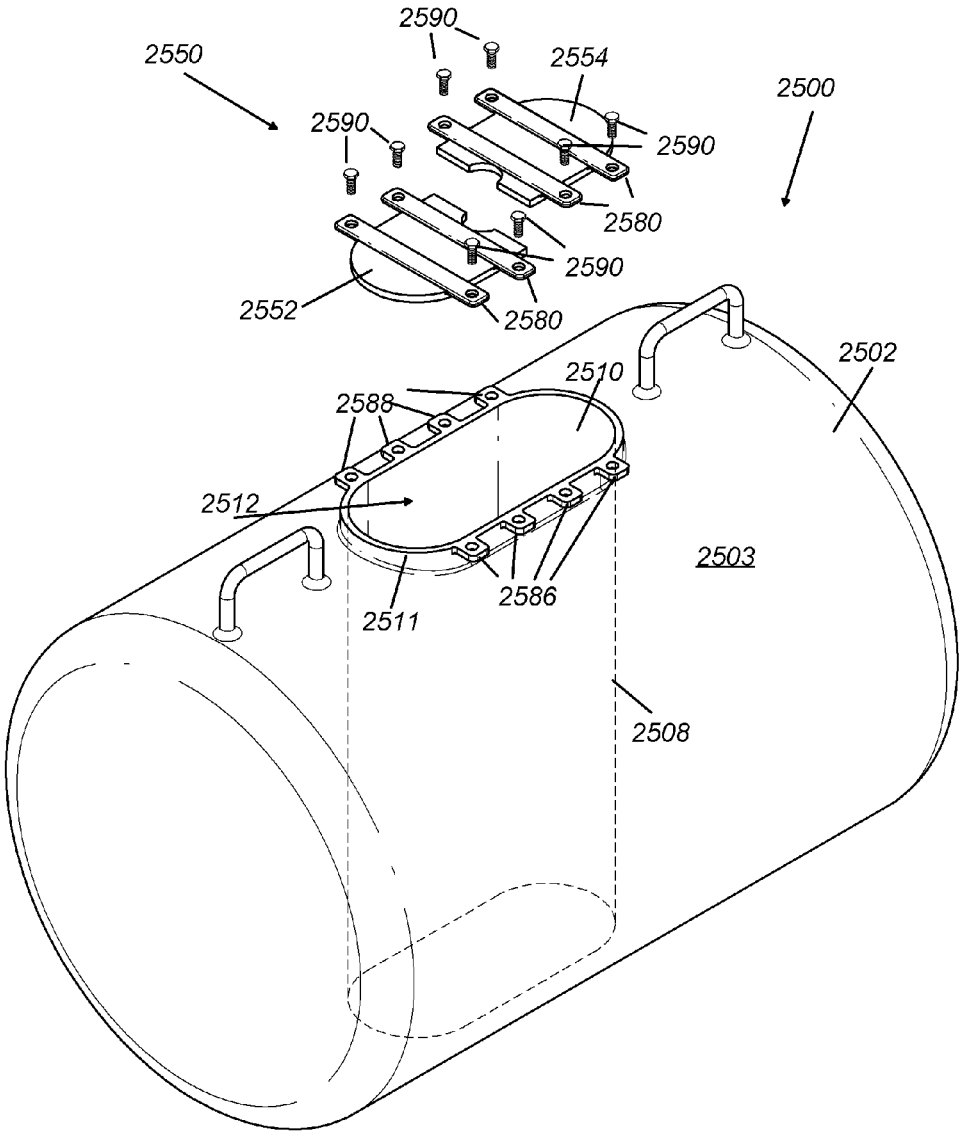
FIG. 25 schematically illustrates a floating anchor buoy and loop-securing structure according to another embodiment.
Figure 26:
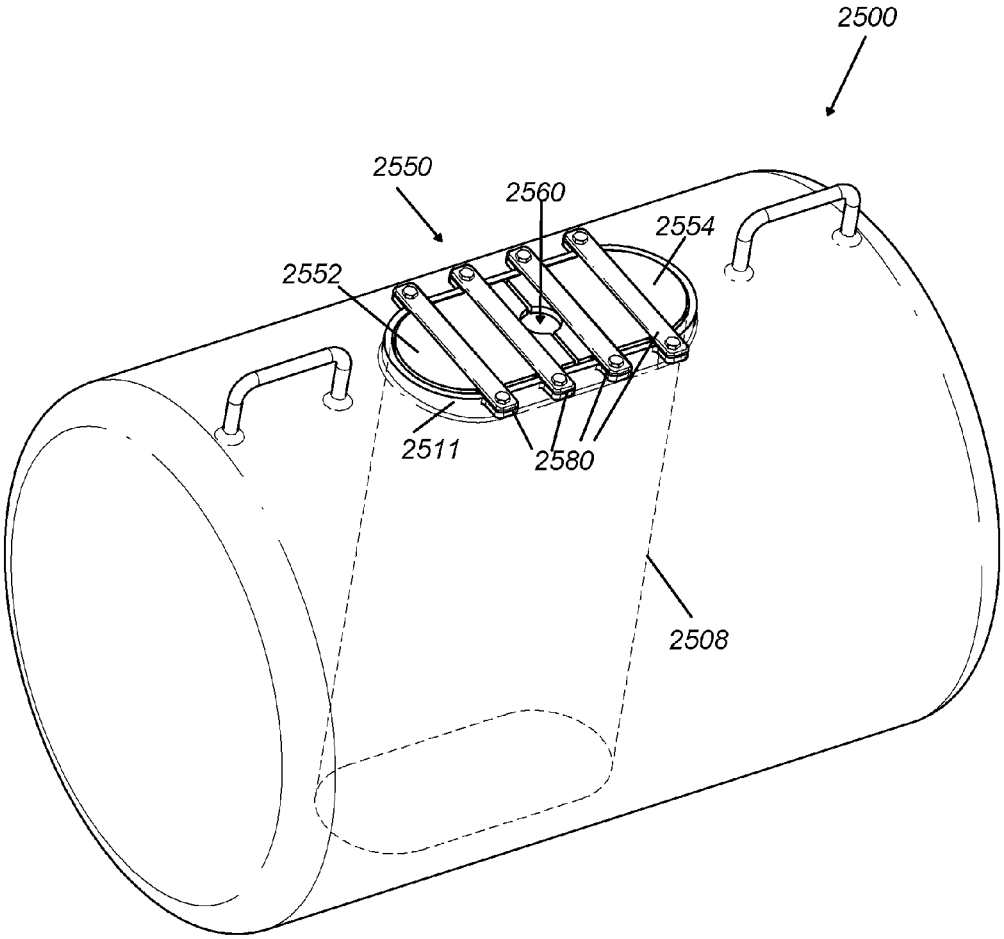
FIG. 26 schematically illustrates the loop-securing structure and floating anchor buoy of FIG. 25 in a closed position.

FIGS. 25 and 26 illustrate another embodiment of a buoy assembly 2500. As in the embodiments discussed above, a passage 2512 is formed through the buoy 2502 to allow a looped wire cable to pass through the buoy 2502. The passage 2512, as shown, may be an extruded oval shape. One opening 2510 into the passage 2512 is illustrated in FIG. 25. In one embodiment, the opening 2510 may be 10 inches long by 4 inches wide. In other embodiments, the opening 2510 may be up to 5 inches long, up to 7 inches long, up to 10 inches long, or up to 14 or more inches long. In other embodiments, the opening 2510 may be up to 2 inches wide, up to 4 inches wide, up to 6 inches wide, or up to 8 or more inches wide. An insert 2508 may be welded or otherwise secured to the buoy 2502 at the openings 2510 to form the passage 2512 and maintain a water-tight compartment within the buoy 2502. A collar 2511, similar to the collars discussed above with respect to the other embodiments, surrounds the opening 2510 and provides an engagement surface for the plates 2552, 2554 of the loop-securing structure 2550. The plates 2552, 2554 desirably include curved cutouts that form an opening 2560 (FIG. 26). As discussed above, the plates may be of virtually any shape that suffices to create, when the plates are put together, an opening just slightly larger than the diameter of a wire cable, as shown in FIG. 25. As shown in FIG. 25, the collar 2511 may also include a plurality of tabs 2586, 2588 extending away from the opening 2510. The tabs 2586, 2588 may be used to secure a plurality of bars 2580 that preferably extend over and secure the plates 2552, 2554 to the buoy 2502. As illustrated, the bars 2580 are preferably secured to the tabs 2586, 2588 using mechanical fasteners such as bolts 2590. In other embodiments, any type of retaining assembly, such as the aligned retaining members and bolts or pins shown in FIGS. 19 and 22 may be used to secure the plates 2552, 2554 in a closed position as shown in FIG. 26.

In some embodiments, two buoyant bodies may be hinged such that a half channel welded to each buoyant body becomes an enclosed channel when the buoyant bodies are closed and secured together. For example, a first buoyant body may be fully waterproof and have a first half channel welded to a side face of the buoyant body. A second buoyant body may also be fully waterproof and have a second half channel welded to a side face of the buoyant body. The two side faces of the first and second buoyant bodies may be hinged together such that the buoyant bodies can rotate open and closed. When the buoyant bodies are in a closed position, the two half channels form a complete and enclosed circular, square, or rectangular channel, depending on the cross-section of the channel. The diameter of the enclosed channel, when the buoyant bodies are in the closed position, is preferably less than the largest diameter of a loop of a wire cable such that the loop is prevented from passing through the enclosed channel, similar to the designs discussed above. Any latching mechanism that can secure the buoyant bodies together in a closed position may be used.

In another embodiment, a half channel may be formed integrally with a side of a first buoyant body while a second half channel may be formed integrally with a second of a second buoyant body. The buoyant bodies may be hinged such that a wire cable may be placed within the channels. As in the designs discussed above, the diameter of the channel is less than the largest diameter of a loop of a wire cable such that when the buoyant bodies are hinged together in a closed position the channel envelopes the cable, allowing the cable to freely pass through the channel while preventing the loop from passing through the channel.

In yet another embodiment, two buoyant bodies may be hinged together such that a channel welded or formed integrally with a side of one of the buoyant bodies becomes an enclosed channel when the buoyant bodies are closed and secured together. The channel may be formed integrally with a side of a first buoyant body or welded to a side of the first buoyant body. When in a closed position, the side of the buoyant body closes against the opening in the channel to form an enclosed channel. As in the embodiments discussed above, the diameter of the channel when the buoyant bodies are closed together is less than the largest diameter of a loop of a wire cable to prevent the loop of the wire cable from passing through the channel. It will also be appreciated that variations in buoyancy between the bodies may exist ranging from slight differences to large differences, and in some embodiments one of the bodies or structures helping to form a channel may have little or no buoyancy.

Clarifications Regarding Terminology

Although various marine buoys, such as anchor buoys or anchor cans, have been disclosed in the context of certain embodiments and examples, the present disclosure extends beyond the specifically disclosed embodiments to other alternative embodiments and/or uses of the buoys and obvious modifications and equivalents thereof. In addition, while several variations of the buoys have been shown and described in detail, other modifications, variations and embodiments are within the scope of the present disclosure. This disclosure expressly contemplates that various features and aspects of the disclosed embodiments can be combined with, or substituted for, one another.

Several of the figures illustrate a single opening in each buoy. While not illustrated, each buoy comprises two openings to define a passage through the buoy, the passage configured such that a looped wire cable can pass through the buoy. While some of the embodiments discussed above illustrate that the same loop-securing structure is used on both openings of the passage through the buoy, in some embodiments different loop-securing assemblies may be used at each opening. Moreover, as used herein, one of ordinary skill in the art will appreciate that "loop" broadly includes any of several possible configurations at one end of an anchor line, including a ring, an eye or a hook or other structure that can be gripped and used to raise an anchor attached at the other end of the anchor line.

For expository purposes, the term "lateral" as used herein is defined as a plane generally parallel to the plane or surface of the floor of the area in which the device being described is used or the method being described is performed, regardless of its orientation. The term "vertical" refers to a direction generally perpendicular to the lateral as just defined.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount correlated to reasonable tolerances and variations in construction or implementation of components or aspects of the inventions herein that fall within practical limits and/or do not impede the making or using of the inventions. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by an amount that does not impede the making or using of the inventions.

Some embodiments have been described in connection with the accompanying drawings. The figures may be generally drawn to scale, but any such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Moreover, while illustrative embodiments have been described herein, the scope of any and all embodiments having equivalent elements, modifications, omissions, combinations (e.g., of aspects across various embodiments), adaptations and/or alterations as would be appreciated by those in the art based on the present disclosure are part of this specification. The limitations in the claims are to be interpreted broadly based on the language employed in the claims and not limited to the examples described in the present specification or during the prosecution of the application, which examples are to be construed as non-exclusive. The specification and examples should be considered as illustrative only, with a true scope and spirit being indicated by the claims and their full scope of equivalents.

What is claimed is:

1. A floating buoy for holding an anchor line having a loop at one end, the buoy comprising:

a buoyant body;

a first opening and a second opening formed in the buoyant body, the first and second openings connected by a passage through the buoyant body, the first and second openings and the passage sized to allow a loop in an anchor line to move through the first opening and through the passage and through the second opening; and a first loop-securing structure connected to the buoyant body to provide a third opening sized to allow the anchor line to move therethrough and to prevent the loop from moving therethrough;

wherein the first loop-securing structure comprises a first plate and a second plate, each of the first and second plates detachably connected to the buoyant body adjacent to the first opening, the first loop-securing structure movable from an open position to a closed position such that the first loop-securing structure in a closed position defines the third opening.

2. The floating buoy of claim 1, wherein the first loop-securing structure is detachably connected to the buoyant body.

3. The floating buoy of claim 1, wherein the first loop-securing structure is configured to have first and second positions such that, when the first loop-securing structure is in the second position, the third opening is sized to allow the anchor line to move therethrough and to prevent the loop from moving therethrough, and such that, when the first loop-securing structure is in the first position, the third opening is larger than it is when the first loop-securing structure is in the second position.

4. The floating buoy of claim 1 further comprising a second loop-securing structure comprising a third plate and a fourth plate, each of the third and fourth plates detachably connected to the buoyant body substantially adjacent to the second opening, the second loop-securing structure movable from an open position to a closed position, and the second loop-securing structure in the closed position defines the third opening.

5. The floating buoy of claim 1, wherein the third opening is approximately centered over the first opening.

6. The floating buoy of claim 1, wherein each of the first and second openings is circular.

7. The floating buoy of claim 1, wherein each of the first and second openings is rectangular.

8. The floating buoy of claim 1, wherein a diameter of each of the first and second openings is at least 12 inches.

9. The floating buoy of claim 1, wherein each of the first plate and the second plate is a half-circle shape.

10. The floating buoy of claim 1, wherein each of the first plate and the second plate is rectangular.

11. The floating buoy of claim 1, wherein the first plate further comprises a first retaining member and a second retaining member and the second plate further comprises a third retaining member and a fourth retaining member such that a first securing member is inserted into the first and third retaining members and a second securing member is inserted into the second and fourth retaining members to secure the loop-securing structure in a closed position.

12. The floating buoy of claim 11, wherein each of the first and second securing members is a bolt.

13. The floating buoy of claim 11, wherein the first and second securing members are removably secured with locking nuts.

14. A floating buoy for holding an anchor line having a loop at one end, the buoy comprising:

a buoyant body;

a first opening and a second opening formed in the buoyant body, the first and second openings forming a passage through the buoyant body; and a loop-securing structure detachably connected to the buoyant body adjacent to the first opening, the loop-securing structure movable from a first position to a second position, the loop-securing structure configured to at least partially cover the first opening and the loop-securing structure configured such that in the first position it defines a third opening that is narrower than both of the first opening and the second opening;

wherein the loop-securing structure comprises a first plate and a second plate, each of the first and second plates detachably connected to the buoyant body adjacent to the first opening.

15. The floating buoy of claim 14, wherein the third opening is approximately centered over the first opening.

16. The floating buoy of claim 14, wherein the buoyant body further comprises a collar secured to the buoyant body such that the collar surrounds and is adjacent to the first opening.

17. The floating buoy of claim 14, wherein each of the first plate and the second plate are hingeably attached to the buoyant body.

18. The floating buoy of claim 14 further comprising a collar secured to the buoyant body such that the collar surrounds and is adjacent to the first opening, the collar further comprising a groove formed in an interior perimeter of the collar and the first and second plates slide from a first position to a second position within the groove.

19. The floating buoy of claim 16, wherein the loop-securing structure further comprises a rectangular plate having angled surfaces defining a loop-securing opening in the plate, the third opening forming part of the loop-securing opening, the plate detachably secured to the collar with a plurality of mechanical fasteners.

20. The floating buoy of claim 16, wherein the collar further comprises a tab extending from the collar into the first opening such that the tab extends into the loop-securing opening when the loop-securing structure is secured to the collar.

21. The floating buoy of claim 16, wherein the first plate and the second plate are hingeably attached to the first plate such that the first plate can rotate with respect to the second plate, each of the first plate and the second plate detachably secured to the collar with a plurality of mechanical fasteners.

22. A floating buoy for holding an anchor line having a loop at one end, the buoy comprising:

a buoyant body;

a first opening in the buoyant body, the first opening having an area that is at least as large as twice the cross-sectional area of an anchor line; and a securing structure configured to have first and second positions, the securing structure, when in the first position, defining a securing opening, the securing opening having an area that is smaller than twice the cross-sectional area of the anchor line;

wherein the securing structure comprises a first plate and a second plate, each of the first and second plates detachably connected to the buoyant body adjacent to the first opening, wherein each of the first plate and the second plate is a half-circle shape.

23. The floating buoy of claim 22, further comprising:

a second opening in the buoyant body, the second opening having an area that is at least as large as twice the cross-sectional area of the anchor line.

24. The floating buoy of claim 23, wherein the first opening is located on a top side of the buoy, the second opening is located on a bottom side of the buoy, and the securing opening is concentric with one of the first opening and the second opening.

* * * * *